US009586117B2

(12) United States Patent
Freund

(10) Patent No.: US 9,586,117 B2
(45) Date of Patent: Mar. 7, 2017

(54) BALL REBOUNDING SYSTEM

(71) Applicant: Kurt T Freund, St. Louis, MO (US)

(72) Inventor: Kurt T Freund, St. Louis, MO (US)

(73) Assignee: Sportworx, LLC, Imperial, MO (US)

( * ) Notice: Subject to any disclaimer, the term of this patent is extended or adjusted under 35 U.S.C. 154(b) by 390 days.

(21) Appl. No.: 14/034,253

(22) Filed: Sep. 23, 2013

(65) Prior Publication Data

US 2014/0094327 A1 Apr. 3, 2014

Related U.S. Application Data

(60) Provisional application No. 61/704,455, filed on Sep. 22, 2012, provisional application No. 61/786,462, filed on Mar. 15, 2013.

(51) Int. Cl.

*A63B 69/00* (2006.01)
*A63B 71/02* (2006.01)
*A63B 47/00* (2006.01)

(52) U.S. Cl.

CPC ..... *A63B 69/0097* (2013.01); *A63B 47/00* (2013.01); *A63B 71/022* (2013.01); *A63B 2071/024* (2013.01); *A63B 2071/025* (2013.01); *A63B 2210/50* (2013.01); *A63B 2225/09* (2013.01); *Y10T 29/49826* (2015.01)

(58) Field of Classification Search

CPC ... A63B 69/0097; A63B 63/00; A63B 63/004; A63B 69/0002; A63B 71/0002; A63B 2069/0006

USPC ..... 273/395, 396, 398–402; 473/434, 435, 473/431, 476–478

See application file for complete search history.

(56) References Cited

U.S. PATENT DOCUMENTS 2,992,002 A 7/1961 Bingham, Jr.
3,195,898 A * 7/1965 Respini ..... A63B 63/00 135/118
3,427,026 A * 2/1969 Mahoney ..... A63B 69/0097 273/395
4,082,271 A 4/1978 Martin
4,239,235 A 12/1980 Torres
4,264,070 A 4/1981 Torres (Continued)

OTHER PUBLICATIONS

International Search Report with Written Opinion of the International Searching Authority, PCT/US2013/061216, Feb. 18, 2014.

*Primary Examiner* — Mark Graham
(74) *Attorney, Agent, or Firm* — CreatiVenture Law, LLC; Dennis J M Donahue, III

(57) ABSTRACT

A ball rebounding device has high tension netting that is efficiently assembled, pulled taught and held in place within a frame using a tension rod system and a manufacturing process that uses levers between the frame and tension rods within the frame. The invention can be used in producing new ball rebounder and in retrofitting existing rebounder frames. The frame provides a perimeter support and an interior space. Tension rods are run through the cells of the netting and positioned in the interior space. A lever system is connected between the tension rods and the frame to pull the tension rods toward the corresponding sides of the frame, thereby drawing the net taught within the frame. Once the netting is pulled taught, fasteners hold the tension rods in place next to the sides of the frame. The frame can be rigid or may have flexibility and act like a spring.

29 Claims, 25 Drawing Sheets

(56) References Cited

U.S. PATENT DOCUMENTS 4,274,632 A * 6/1981 Jacobs ..... A63B 61/02 473/492
4,489,941 A * 12/1984 Shieh ..... A63B 71/022 273/395
4,553,751 A 11/1985 Ketchum
4,830,372 A 5/1989 Outlaw
4,948,147 A * 8/1990 Pallanca ..... A63B 63/00 273/396
5,048,844 A * 9/1991 Haseltine ..... A63B 63/004 273/400
5,615,889 A * 4/1997 Long ..... A63B 63/004 273/396
5,816,956 A * 10/1998 Ellis ..... A63B 61/00 473/490
5,833,234 A 11/1998 Vavala
5,857,679 A * 1/1999 Ringe ..... A63B 69/0097 273/395
5,906,552 A * 5/1999 Padilla ..... A63B 69/0097 473/421
6,209,877 B1 4/2001 Warnick
6,299,554 B1 10/2001 Sinclair
6,511,390 B2 * 1/2003 Kim ..... A63B 71/022 273/407
8,246,496 B2 * 8/2012 Holland ..... A63B 63/004 273/400
2002/0013187 A1 * 1/2002 Grunfeld ..... A63B 69/0097 473/446
2003/0060309 A1 * 3/2003 Smith, IV ..... A63B 69/0002 473/431
2008/0067751 A1 3/2008 Hunt
2011/0015002 A1 1/2011 Brown
2011/0053713 A1 3/2011 Bulloch
2012/0208658 A1 8/2012 Christgau
2015/0151179 A1 * 6/2015 Holland ..... A63B 63/004 473/478

* cited by examiner

BALL REBOUNDING SYSTEM

CROSS-REFERENCE TO RELATED APPLICATIONS

This application claims priority from U.S. Provisional Patent Application Nos. 61/704,455 and 61/786,462 respectively filed on Sep. 22, 2012 and Mar. 15, 2013 which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to ball rebounding devices, and more particularly to rebounding systems in which a tensioning device pulls the net taut within a frame.

Related Art

Ball rebounding devices are used for many sports. Most ball rebounding devices use bungee cords or some other spring mechanism to hold nets and other fabrics within the frame, such as in U.S. Pat. Nos. 2,992,002, 4,489,941, 5,833,234 and 6,299,544 while other ball rebounding devices have a flexible margin between the net and the frame, such as in U.S. Pat. Nos. 5,615,889 and 4,082,271. However, these spring elements and flexible margins reduce the overall tension in the net, thereby reducing the rebound effect of the rebounding device, i.e., the amount of a ball's potential energy, or other projectile, that is converted into kinetic energy when the projectile hits the net. Conversion of the potential energy is lost through the springs. Additionally, these known systems lose their rebounding capacity over time as the spring mechanisms or other flexible margins rotate through thousands of expansion and contraction cycles in response to balls being thrown against the nets. The spring-supporting frames of these known rebounders are much more rigid than the springs that hold the nets and do not provide any additional spring flexibility or spring-loading into the overall rebounding system.

Some ball rebounding devices have a rigid margin within an outer frame and have eliminated the springs between the rigid margin and the frame, such as in U.S. Pat. No. 6,209,877 and US Patent App. Pub. No. 2012/0208658, and while these inner/outer frame systems have the capability to pull much higher tensions through the net, their designs are inefficient. In particular, previously known inner/outer frame systems limit the size of the net's cells and the locations in which the net's cells can connect to the inner frame based on the locations of connection elements, such as through-holes for lacing the net's cells or knobs for holding the net's cells. Additionally, these known inner/outer frame systems require the inner frame to be pulled toward the outer frame by individual fasteners that are distributed between the lengths of the frames and do not allow the entire inner frame to be pulled in whole toward the outer frame, simultaneously along the entire length. This inefficiency in the pulling reduces the overall tension that can be obtained and increases the time and cost of manufacturing.

The designs of double-frame systems are also rather inflexible and rigid in order to maintain an equal distance between the inner frame and the outer frame along the length of the frames. They do not provide a flexible outer frame, and the inner frame portions of these known inner/outer frame systems are uniquely designed for their respective outer frames and cannot be used to replace the spring and net systems found in most existing rebounding devices. Accordingly, none of the prior ball rebounding devices could be used as a retrofit system that would be able to be used within existing spring-supporting frames because these frames are only designed to support the lower tensions produced by bungees or other spring mechanisms, and these frames cold not support the higher tensions in these double-frame systems. Also, many of these double-frame systems have holes that must be drilled through the outer frame at particular locations in order to hold the inner frame, and if these holes were to be drilled into the spring-supporting frames, it would further reduce their support capacity and may even compromise the structural integrity of the spring-supporting frames.

There remains a need for a ball rebounding device that can create high tension in nets and can be used with different types of nets, including nets that have different sized cells. It would be another benefit for a ball rebounding system to have structural features which allow for faster and more efficient assembly methods. It would be an additional benefit for a ball rebounding system to be capable of retrofitting the nets and springs or fasteners in existing ball rebounding frames with replacement nets, tension rods and fasteners according to the present invention to provide a better rebound effect or to retrofit the existing frames with an entire frame-rod-net system that can be installed without compromising the structural integrity of the existing frames. It would be another benefit to retrofit the nets in a manner that is less time consuming than the process necessary to install the original nets. It would be another benefit for a ball rebounding system to have a frame which deflects with a spring action as tension is pulled on the net being held in place by the frame.

SUMMARY OF THE INVENTION

The present invention is directed to a ball rebounding device with high tension netting that is efficiently assembled, pulled taught and held in place within a frame using a tension rod system and a manufacturing process that uses levers between the frame and tension rods within the frame. The invention can be used in producing new ball rebounder and in retrofitting existing rebounder frames. The frame provides a perimeter support and an interior space. Tension rods are run through the cells of the netting and positioned in the interior space. A lever system is connected between the tension rods and the frame to pull the tension rods toward the corresponding sides of the frame, thereby drawing the net taught within the frame. Once the netting is pulled taught, fasteners hold the tension rods in place next to the sides of the frame. In one embodiment, the frame is very rigid and does not flex as the tension is placed on the netting. In another embodiment, the frame members have some flexibility and bow as the tension is placed on the netting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
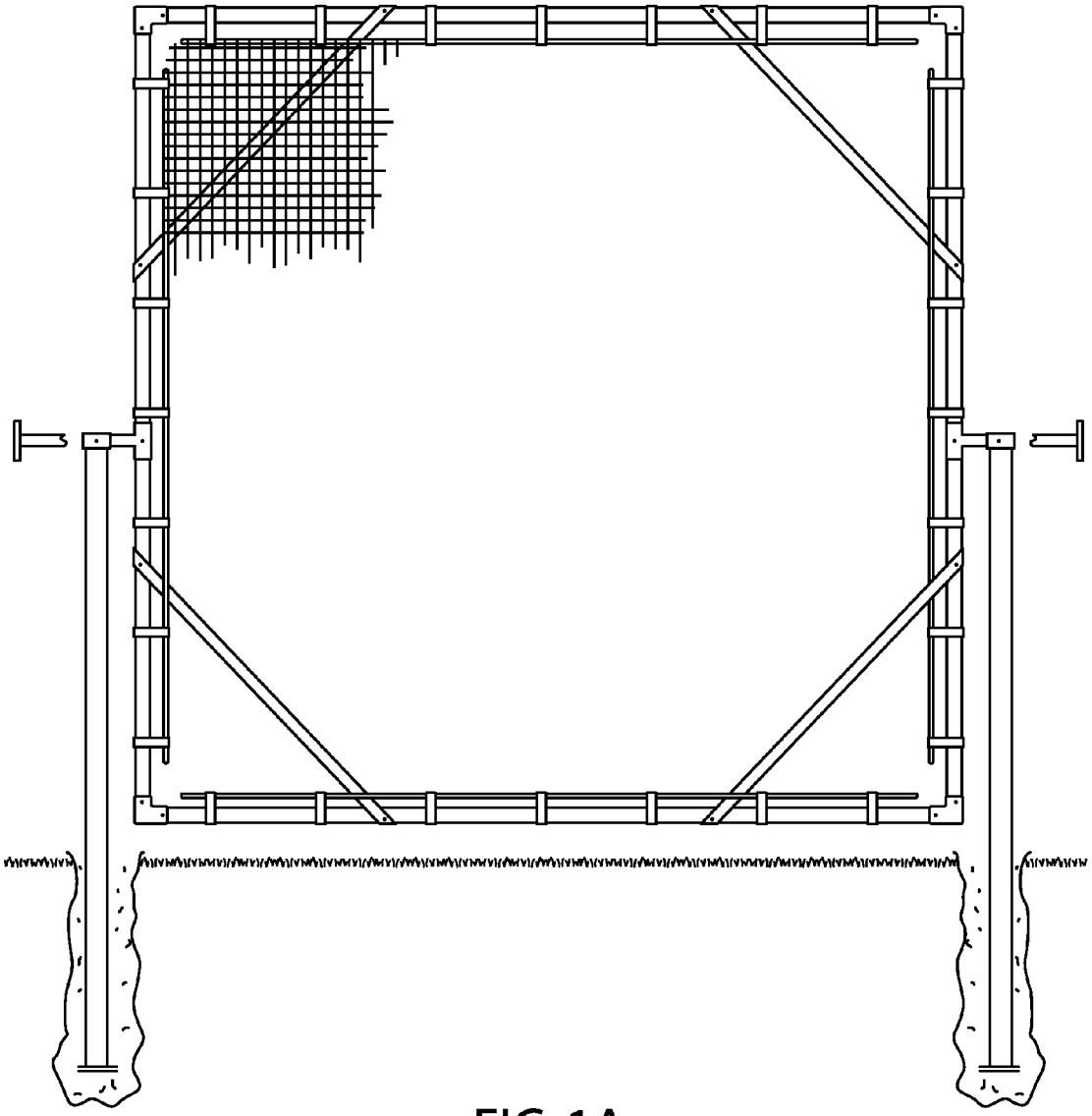
FIGS. 1A & 1B are front views of the rebounder device.
Figure 1B:
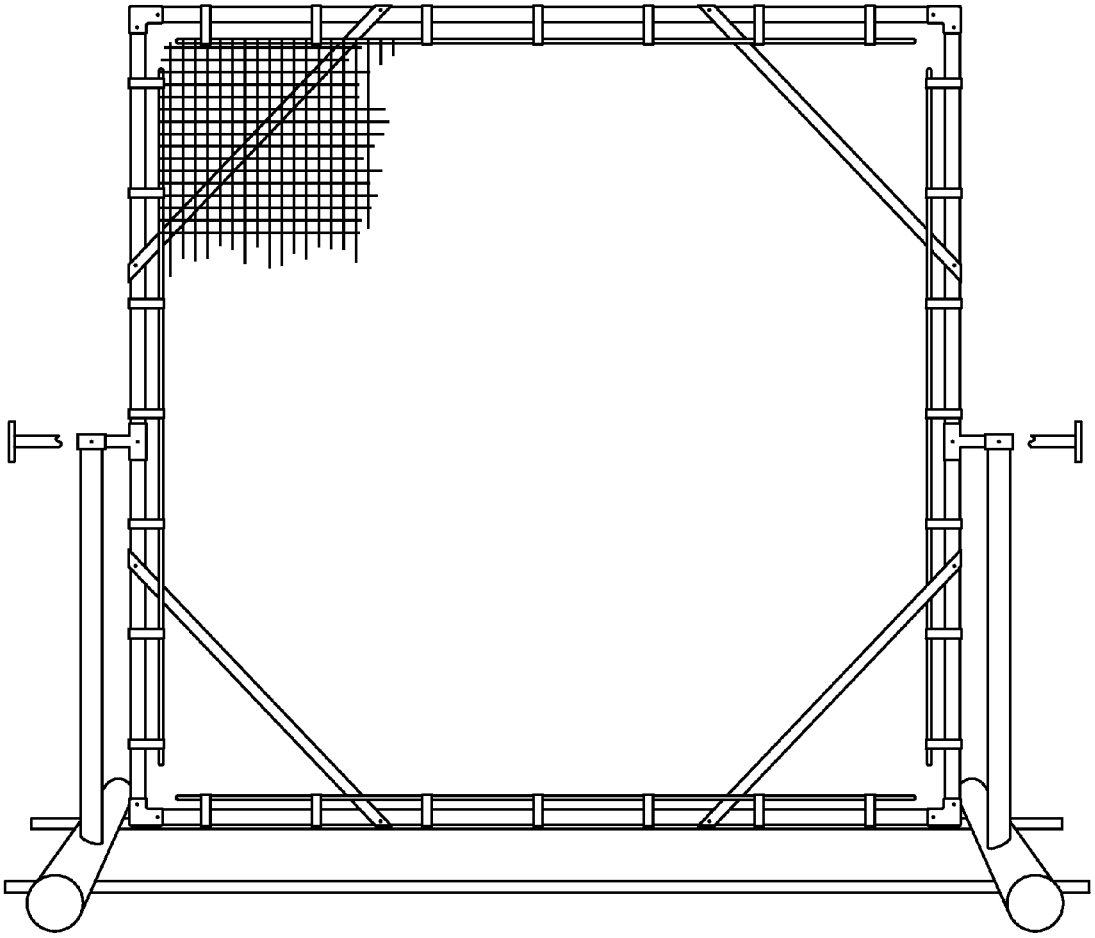
Figure 2:
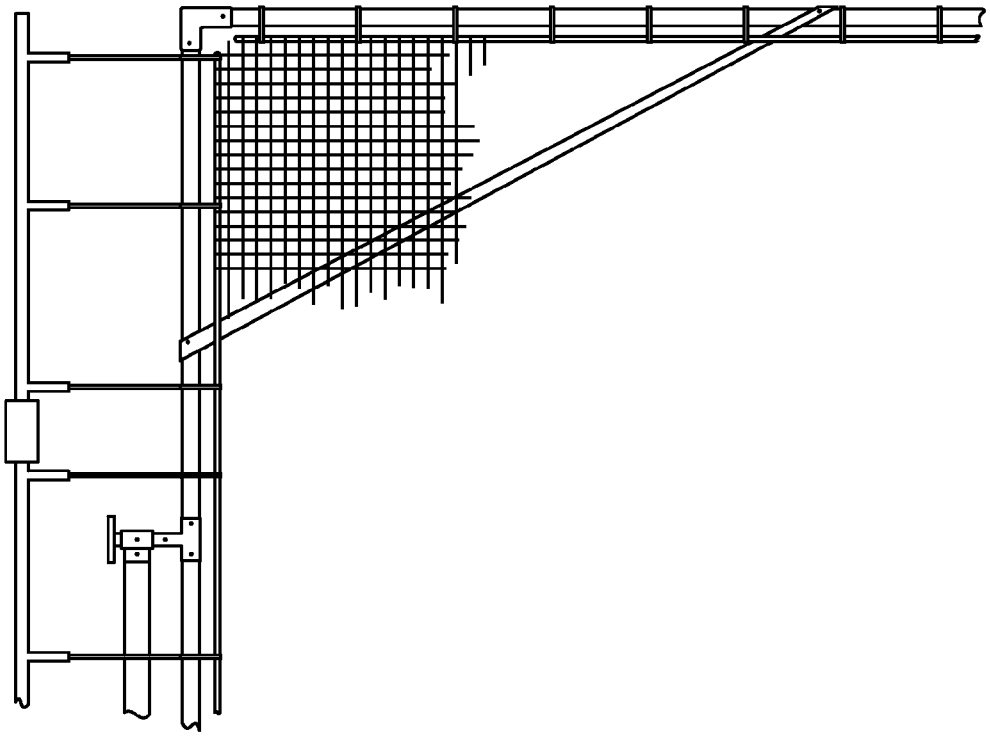
FIG. 2 is a front view of the rebounder device with a lever system.
Figure 3A:
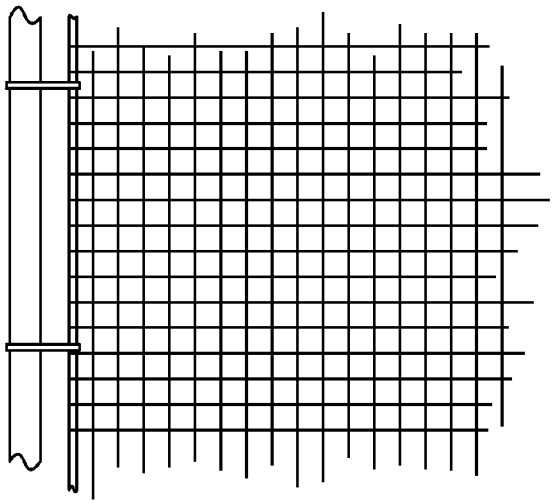
FIGS. 3A-3D are views of alternative fasteners for the rebounder device.
Figure 3B:
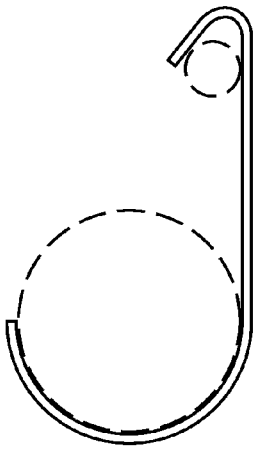
Figure 3C:
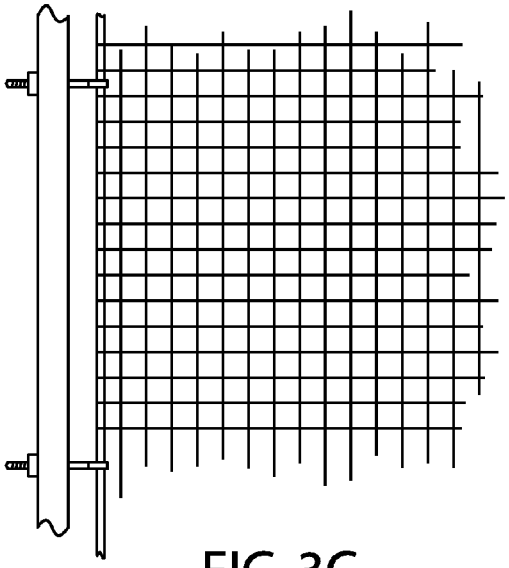
Figure 3D:
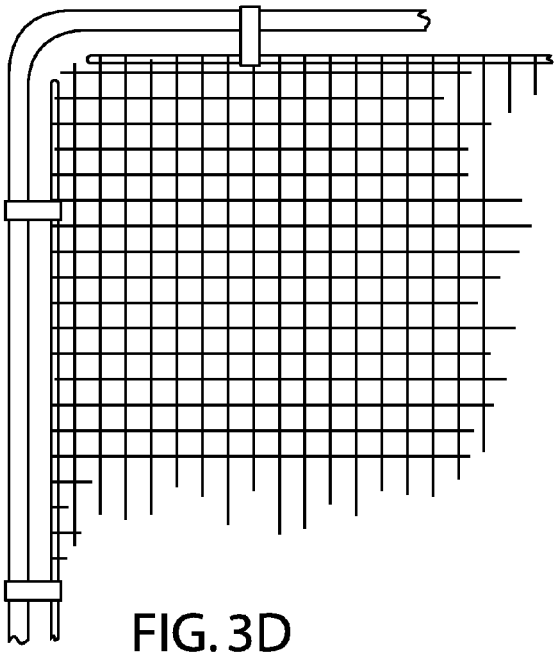
Figure 4A:
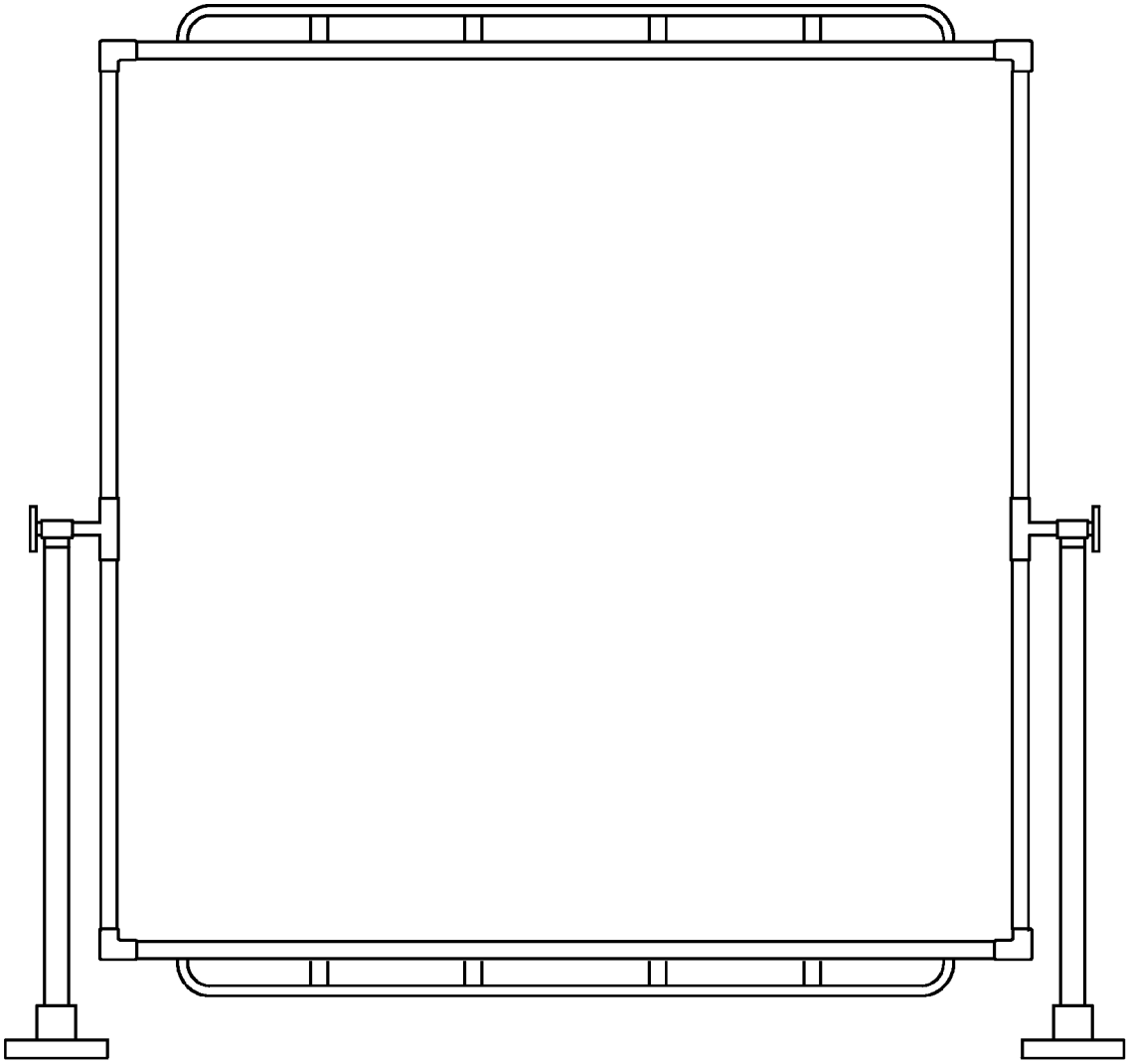
FIGS. 4A & 4B are front views of a rebounder frames with external trusses.
Figure 4B:
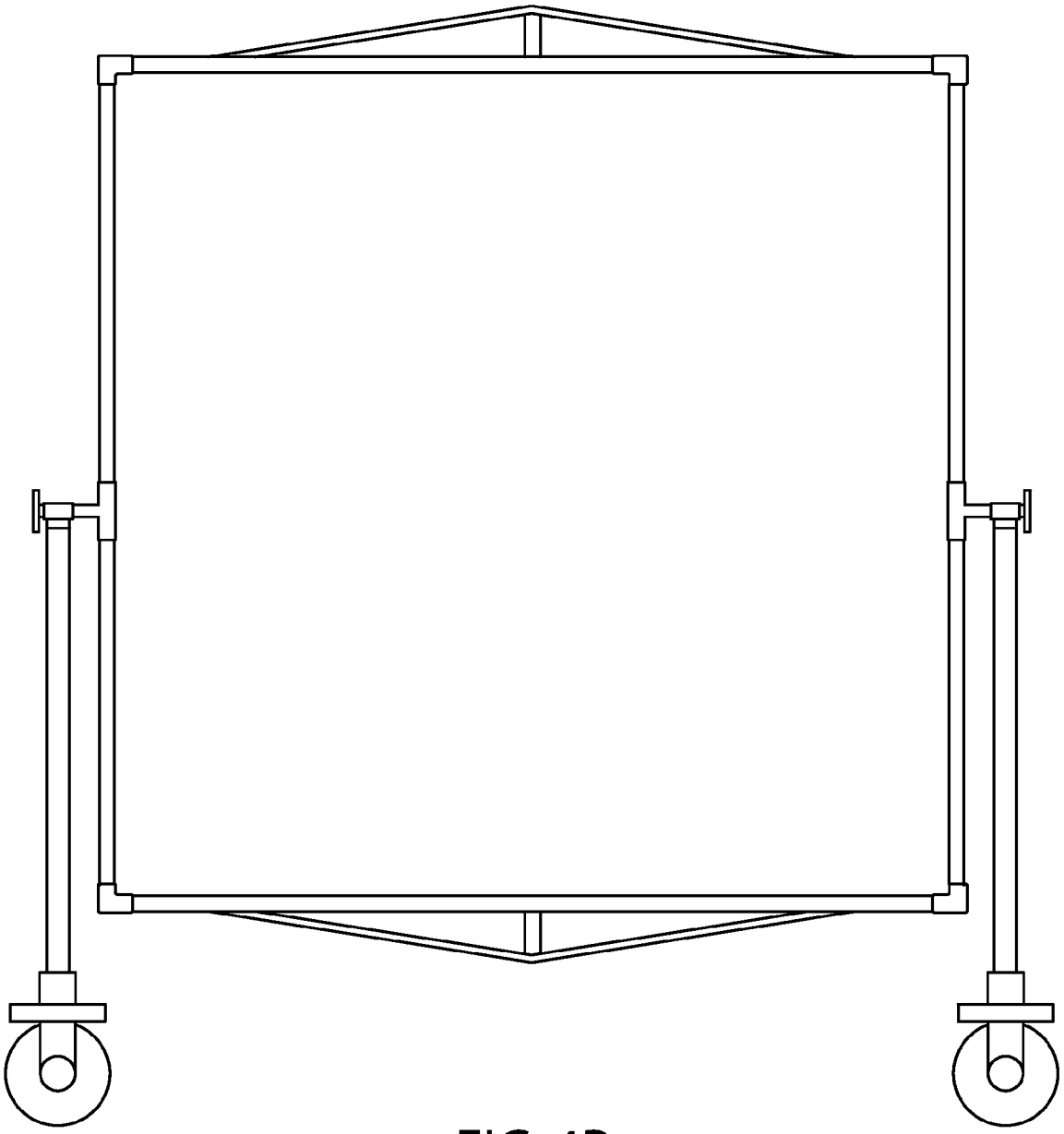

As illustrated in FIGS. 1-3, the ball rebounding system of the present invention has tension rods that are laced by the cells of a net and that hold the net within the interior space of a frame. The invention also includes a lever system which pulls the tension rods toward the frame's perimeter support and thereby pulls the net taut and produces tension within the net. Fasteners hold the tension rods to the frame. The frame preferably includes a bracing system, and as illustrated in FIGS. 1, 2, 4 and 5 and described in further detail below, a variety of braces can be used to provide additional support to the frame. The frame is rotatably held by a pair of tilting hubs or other rotation brackets that are mounted to a corresponding pair of posts, and as illustrated in FIGS. 1, 4 and 7, the posts can be fixed to a ground foundation, installed on a stationary mount or positioned on a mobile platform.

Figure 7A:
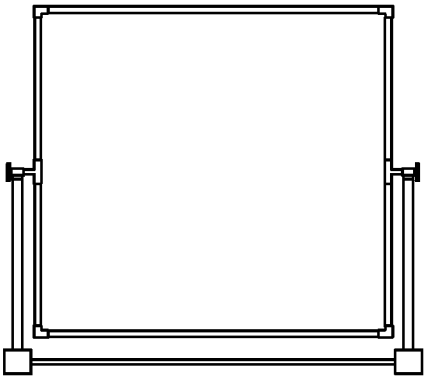
FIGS. 7A-7J are views of rebounders with various mounting arrangements.
Figure 7B:
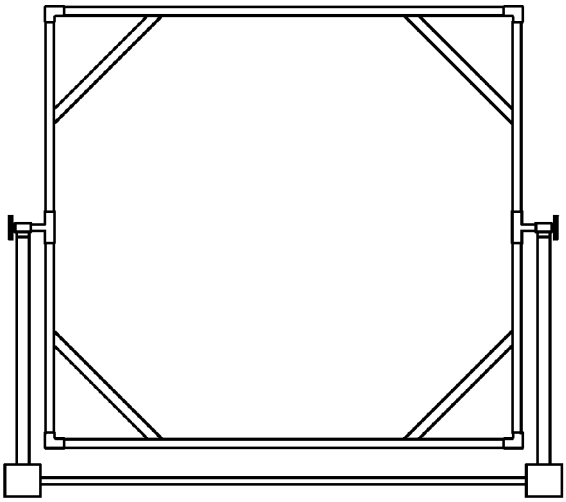
Figure 7C:
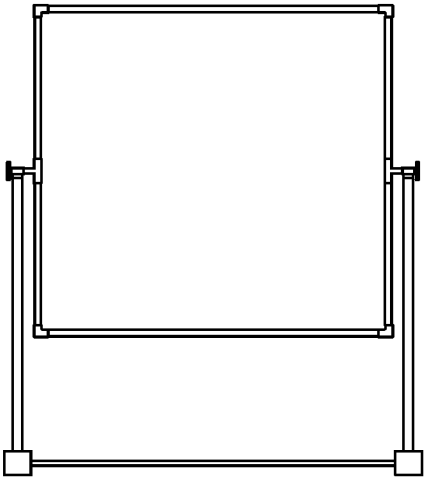
Figure 7D:
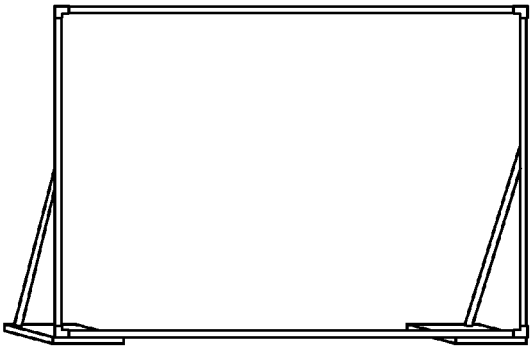
Figure 7E:
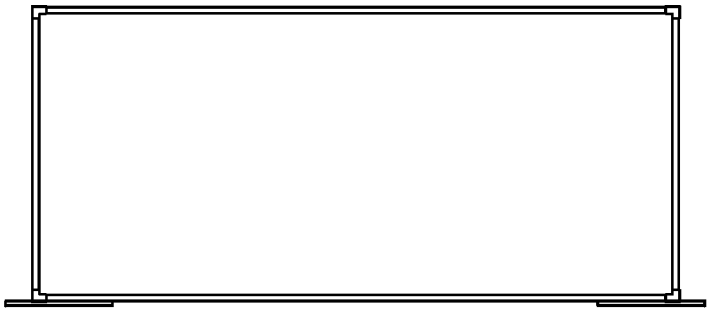
Figure 7F:
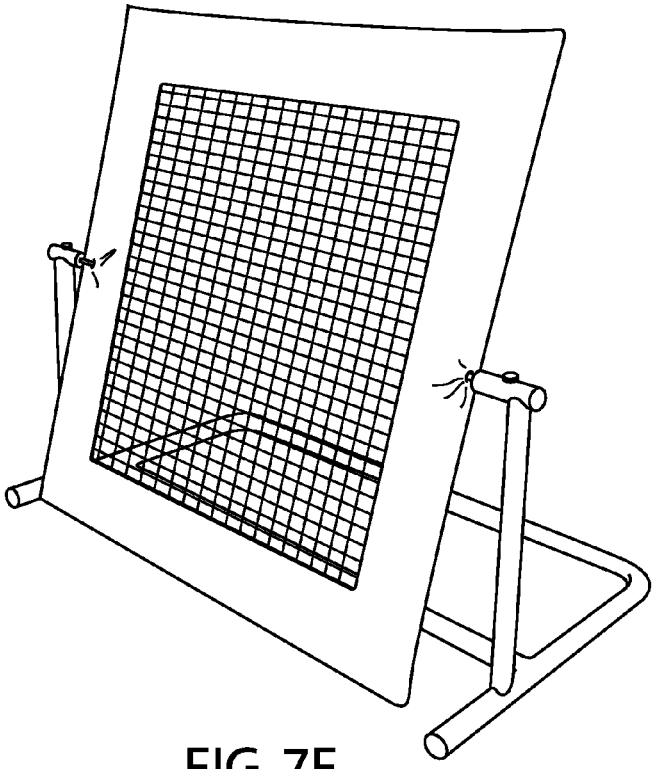
Figure 7G:
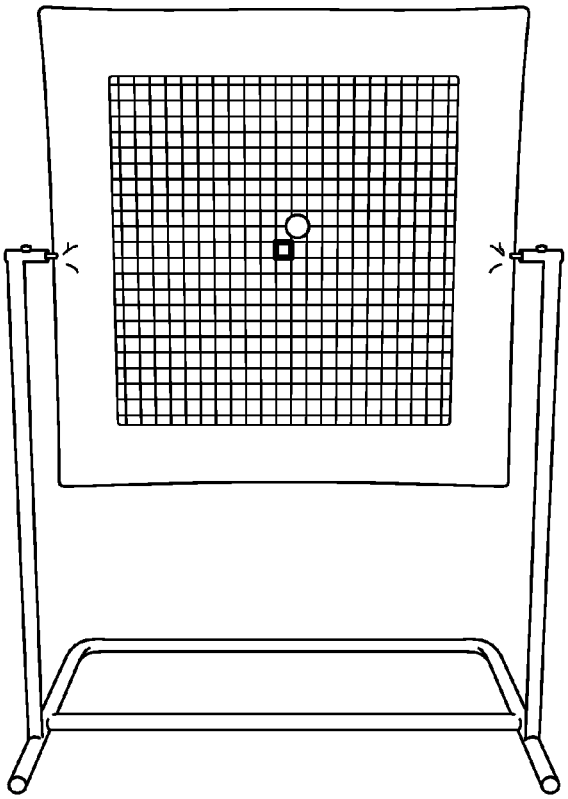
Figure 7H:
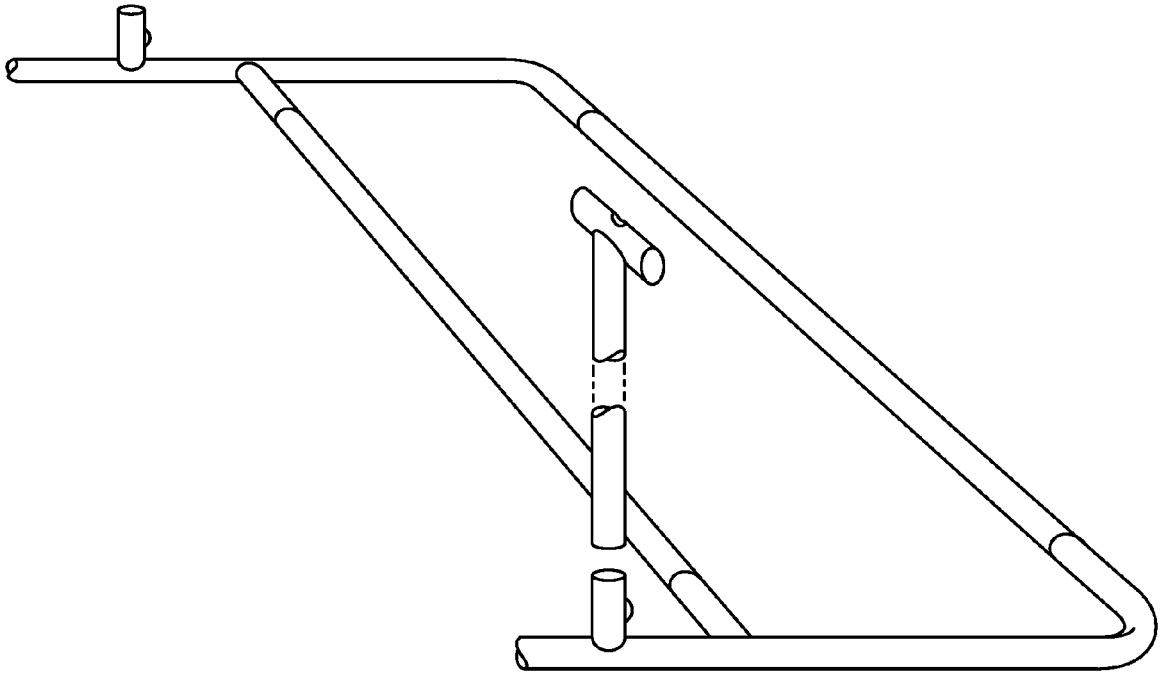
Figure 7I:
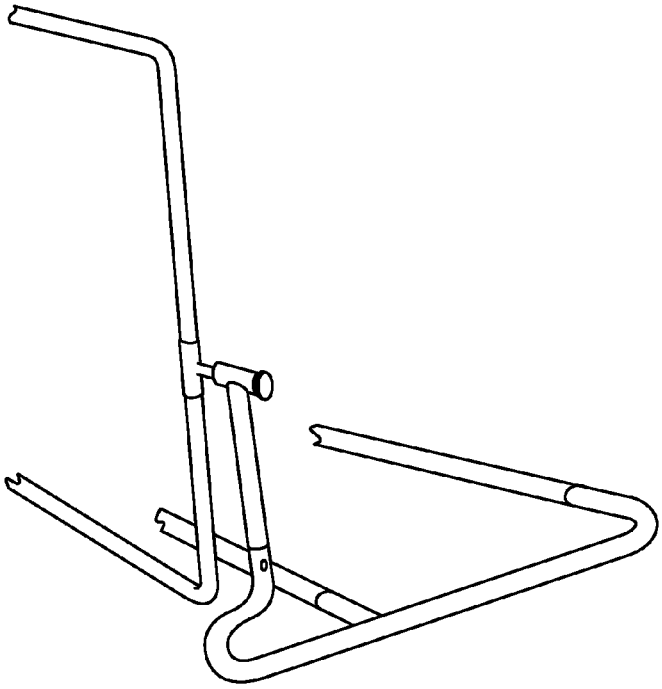

As illustrated in FIG. 7, the ball rebounding system of the present invention can be incorporated into different frames shapes and sizes, and the inventive elements can be retrofitted into existing ball rebounding frames that can withstand the increased tension provided by the present invention. As with other rotatable rebounding devices, the frame rotates to change the inclination of the rebounding action. As particularly shown in FIGS. 7A, 7B and 7C, various aspects of the frame can be modular. For example, a set of short side legs can be replaced with a set of longer side legs or with a set of side leg extensions to elevate the frame away from the ground. Padding can be placed around the periphery of the frame, and a skirt or other covering can be wrapped over the padding, the frame and the tension rods, and the ends of the covering can be glued, epoxied or otherwise secured together around the net or directly to the net if it is a fabric material. Additionally, as shown in FIG. 8, dead blow sheeting can be hung from the top of the frame to transform the rebounder into a ball catcher.

Figure 9A:
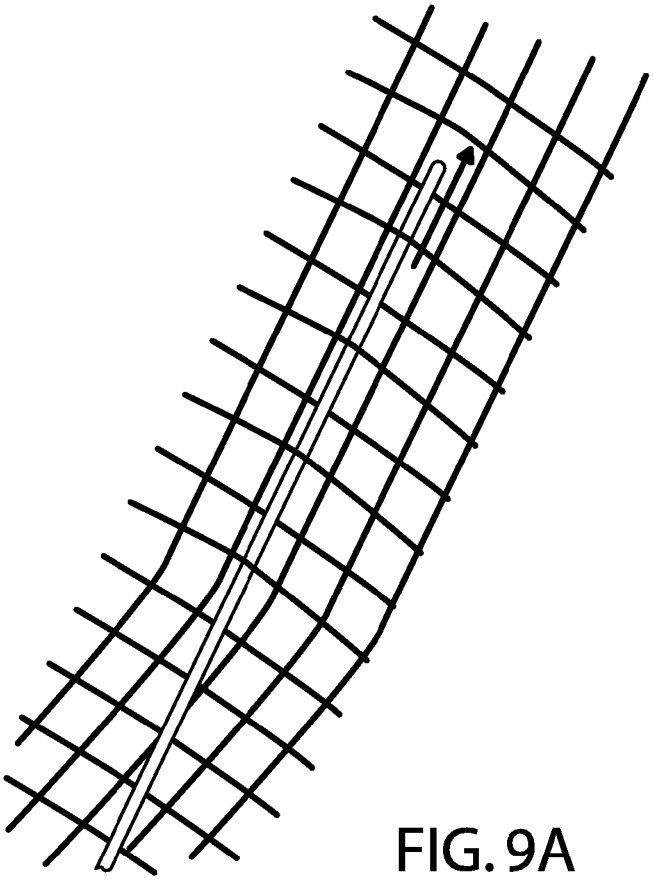
FIGS. 9A-9G are views of a method of assembling the rebounder.
Figure 9B:
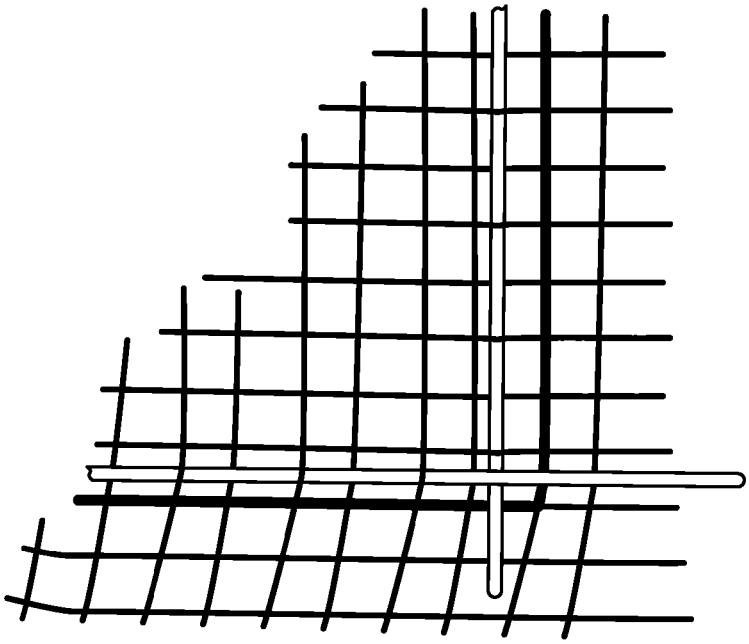
Figure 9C:
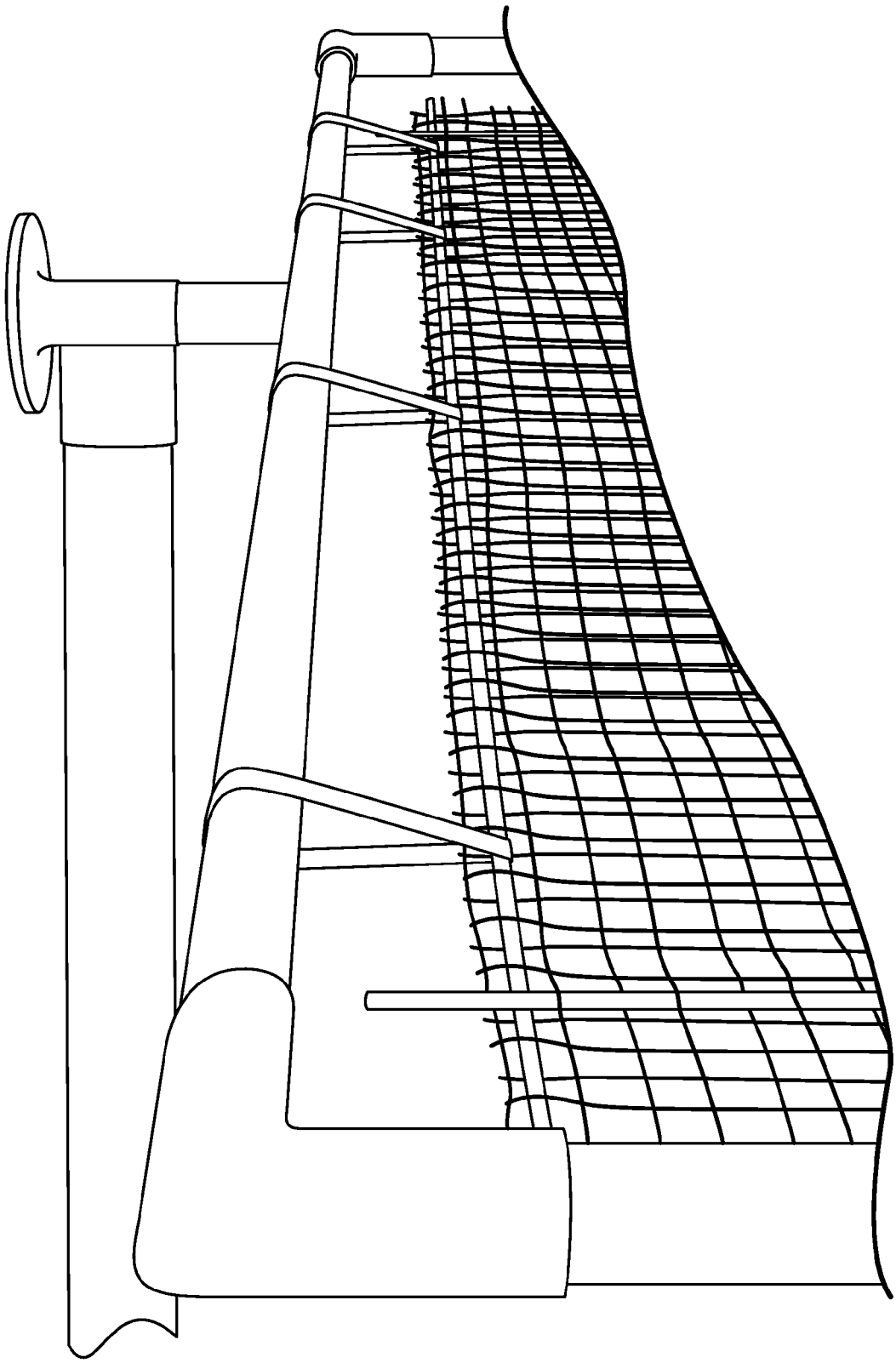

The construction of the ball rebounding system is shown in FIGS. 9A-9G. In one embodiment, four perimeter supports form the top, bottom and sides of the frame. The vertical sides slide into the tilting hub's T-joints which are centered on each corresponding side. The T-joints can be secured to the posts by any fastener, and the embodiment illustrated in FIG. 9C, shows set screws. Corner sleeves connect the top and bottom perimeter supports to the vertical perimeter supports. The braces are attached to provide additional support. The frame is rotatably fixed to the posts through the tilting hubs.

When the net is slack, it is laced onto the tension rods as shown in FIG. 9A. Preferably, the net has marked runs through which the rods can be quickly positioned and inserted as shown in FIG. 9B. The rows of cells that form the marked runs in the net are preferably surrounded by at least one additional row of cells so that the net is slightly oversized and the marked runs are not at the edge of the net. With this slightly oversized net, hot knife cutting can be used to cut the end rows of cells at the net's boundary. It will also be appreciated that it may be helpful to mark the center of the net to help center it on the rods within the frame (see FIG. 7G). The marking of the net's center or the use of marked runs could be particularly helpful with the installation of the net and tension rods within the frame because the rows of cells are directly laced onto the tension rods without any intermediate spring elements and are freely aligned along the tension rods relative to the perimeter support without any cell-position limitations or cell-size limitations according to any position or size requirements of connection points on the frame. Accordingly, nets with different sized cells or screens or other fabrics with various spacing of margin holes can be used within the same frame structure. For screens or other fabrics which have reinforced holes along their margins, the holes are sized to be larger in diameter than the tension rod.

The tension rods with the laced net are preferably arranged orthogonally within the frame's interior space and are loosely held in place by cam straps, bungee cords or other temporary fixtures or jig elements. As particularly illustrated in FIG. 9C, the tension rods are spaced apart from the perimeter support within the interior space when they are held by the cam straps. The cam straps can be used to hold each one of the tension rods in this spaced relationship. Alternatively, one pair of orthogonally arranged rods can be held in their secured position with fasteners proximate to the perimeter support while the opposite pair of rods are held by the cam straps. As illustrated in FIG. 3, different types of fasteners can be used to hold the rods in their secured position, including different forms of hooks, clamps, bolts, straps and ties, such as a C-hooks, S-hooks, J-bolts, C-clamp, wire-ties, etc. As explained in detail below, straps may be used to hold the rods loosely in position and may also be used with a lever and/or a strap tensioner to pull the rods toward the frame and permanently secure the rods proximate to the frame. It will be appreciated that various non-orthogonal arrangements of tension rods may also be used, particularly including curved tension rods (not shown). Also the tension rods do not necessarily need to be threaded along the same row of cells in the net, and the net can be arranged diagonally relative to the tension rods.

Figure 9D:
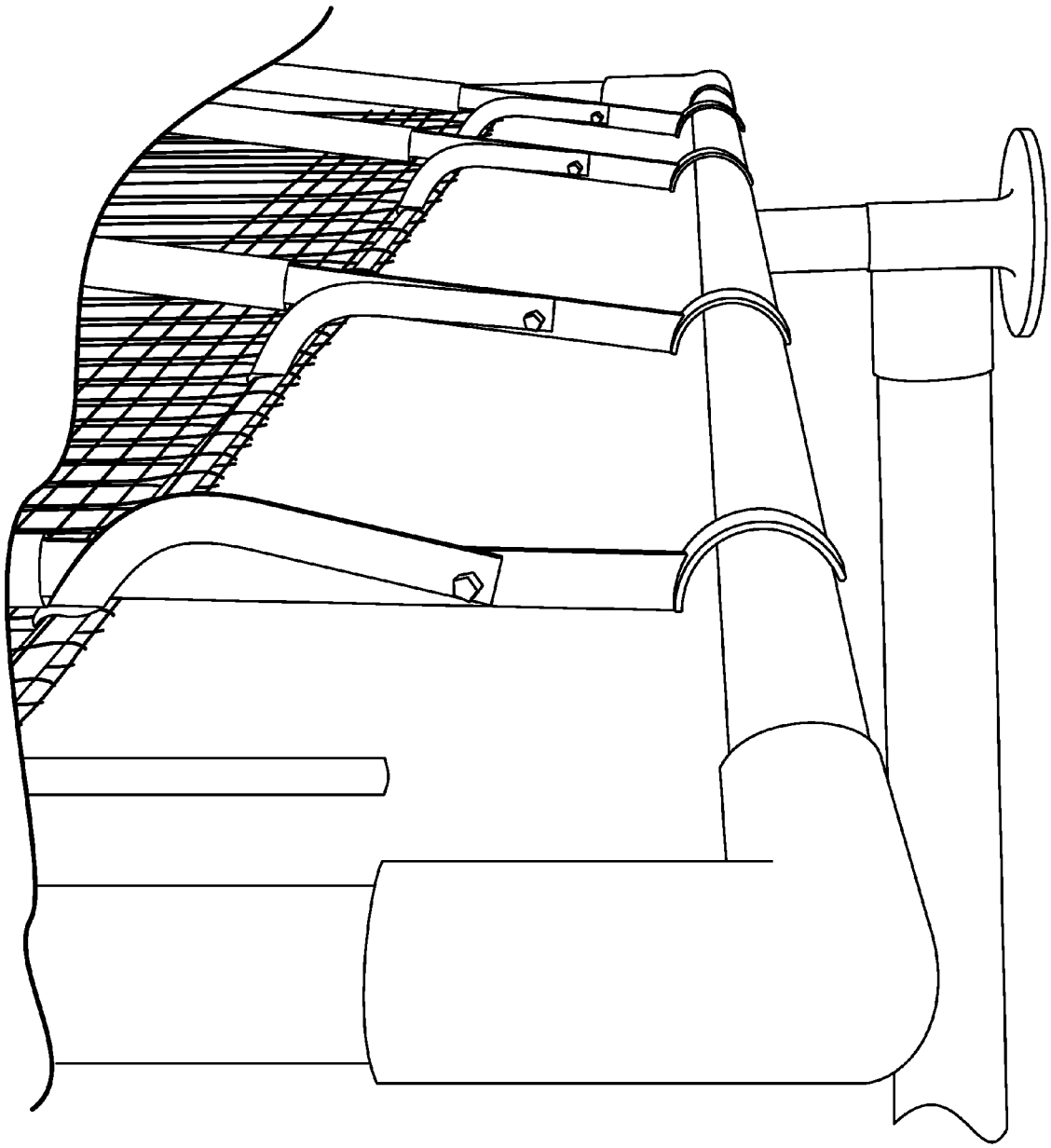
Figure 9E:
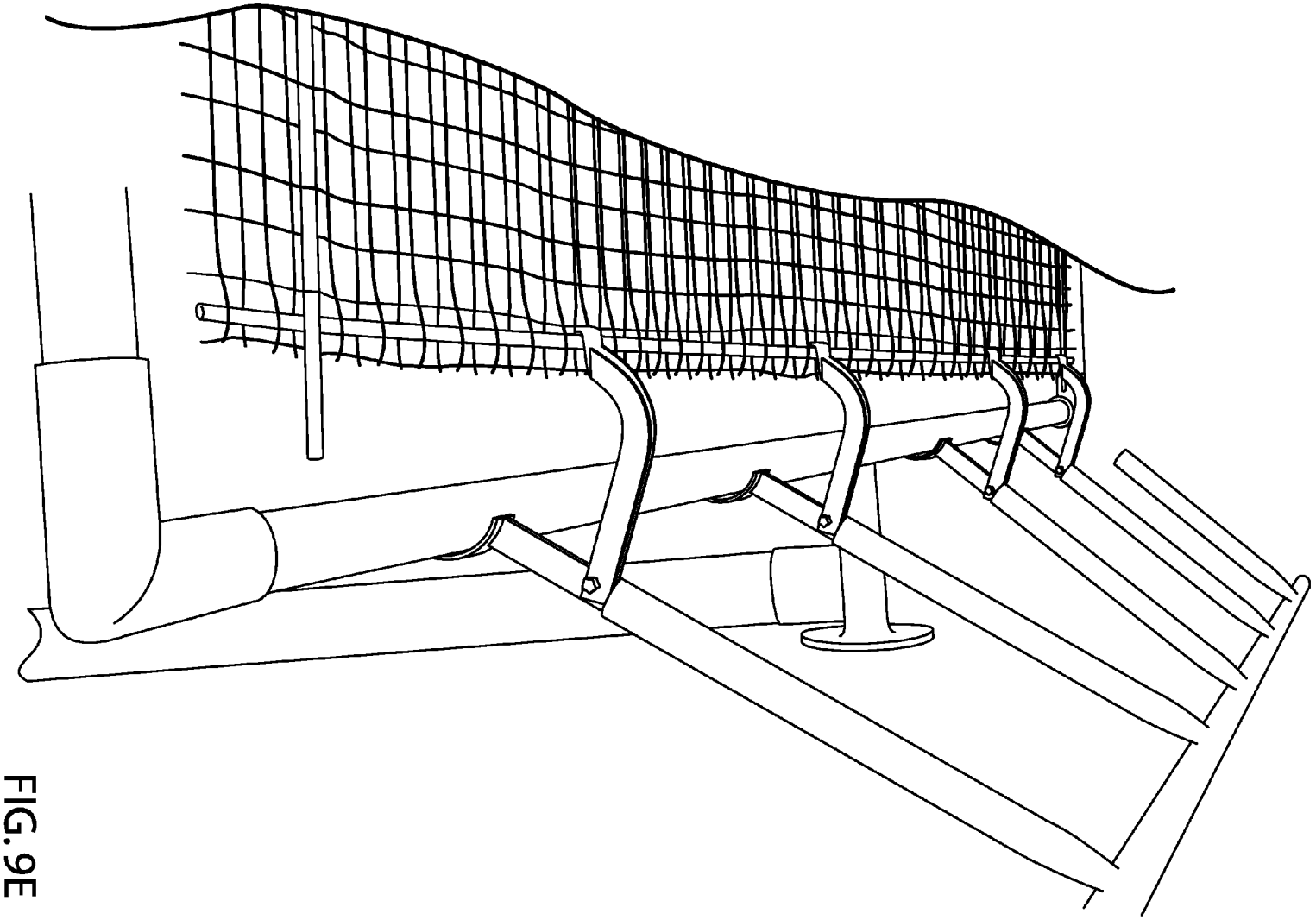
Figure 9F:
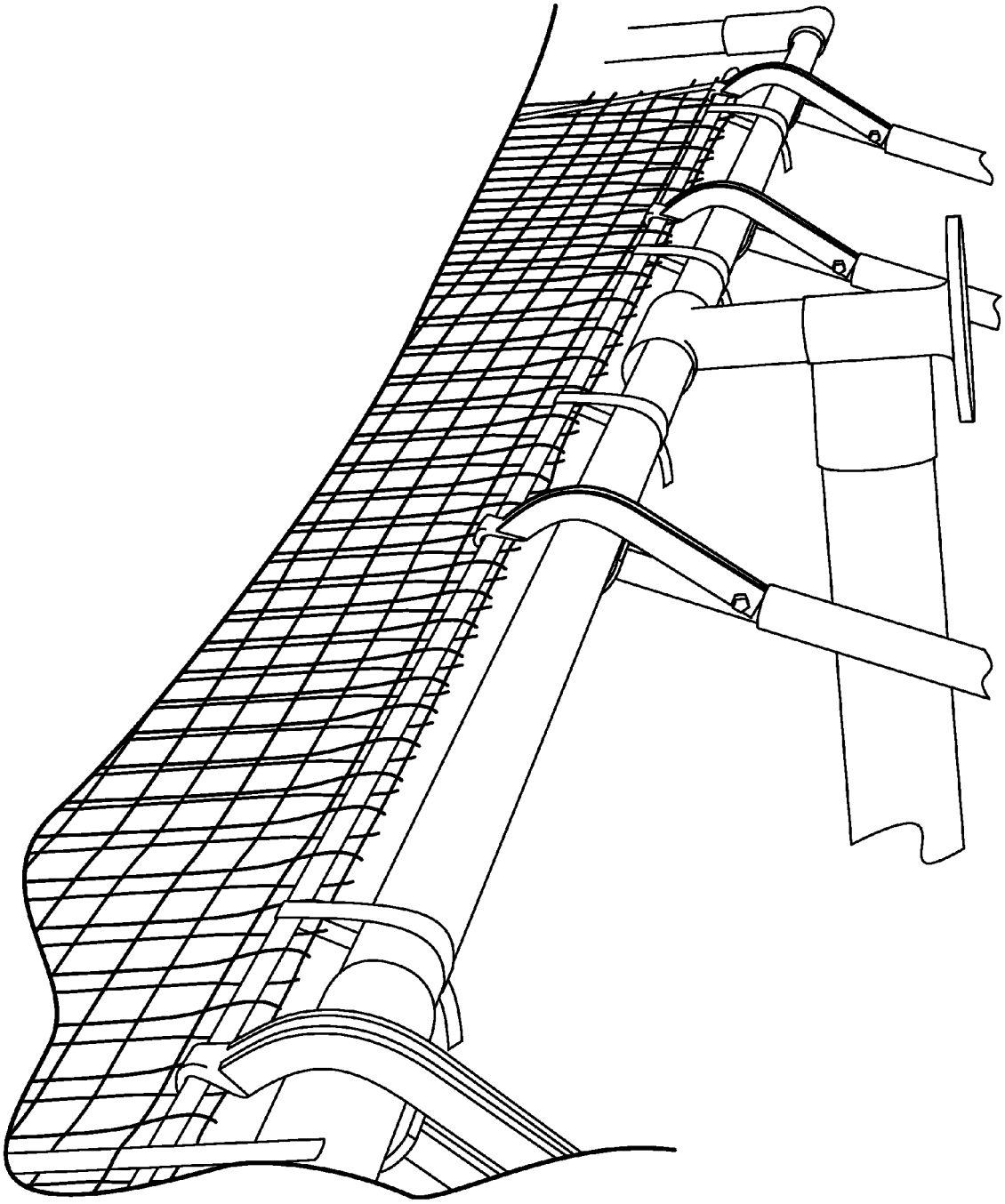

As shown in FIG. 9D-9F, the lever system is connected between the frame's perimeter support and the spaced rods. The lever pulls the tension rod from its spaced position to its secured position, thereby pulling the net from its slackened state to a taut state. When the rod is in its secured position, it is held in place with fasteners. In one embodiment, the lever system is temporarily connected between the rod and the frame so that it can be removed when the fasteners are installed. In another embodiment, the lever system can be permanently fixed between the frame and the rod so that it pulls the rod through the fasteners that secure the rod to the frame. In the preferred embodiment, the net is orthogonally pulled taut. Accordingly, the rod that is adjacent to the rod in its secured position should also be pulled from its spaced position to its secured position and then fixed in place. It will be appreciated that this lever pulling process can be performed on one pair of orthogonally arranged rods while the other pair is securely fixed in place on the frame with fasteners from the start or can be performed on each one of the rods if they all are initially held in place in their respective spaced position.

The lever system preferably operates on the entire length of the tensioning rod simultaneously. Generally, the lever system operates on at least two spaced-apart locations on the rod, and there are preferably three or more locations, with at least two being closer to the ends of the rod and at least one location being toward the center of the rod. The furthest distance between these spaced-apart locations on the rod is preferably at least one half of the rod's length. In the particular embodiment that is shown, the lever system has lever bars and a cross-bar connected between the lever bars, and the lever bars are spaced apart on the frame. The lever bars can be variations of existing lever tools, such as a fence stretcher in the form of a hand tensioner which has an elongated lever arm with a frame-grip at one end, a hand-grip at an opposite end and a rod-grip extension rotatably connected to the lever arm between a middle point and the frame-grip. While this embodiment is shown with a hand operated lever system, it will be appreciated that the lever system can be used within jigs and automated tooling machines.

Figure 9G:
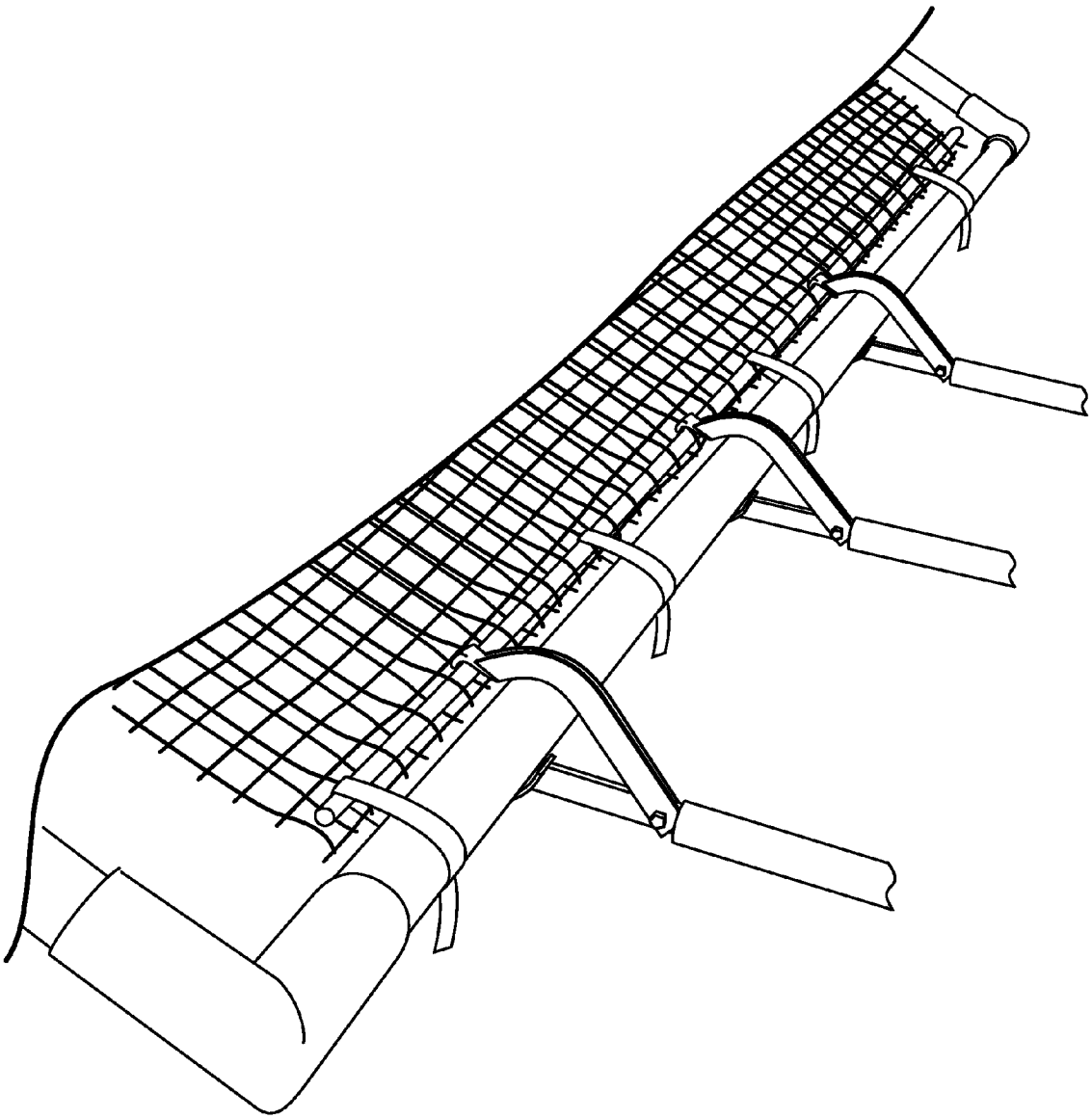

In FIG. 9G, a lever system is shown which acts on one end of a tensioning rod with the other end of the rod bending toward the rod's spaced position. With this arrangement, once the one end is secured, the other end can then be pulled with the same lever system. Although the lever system can operate along sections of the rod as shown in FIG. 9G or at individual points along the rod, such as could be done with a socket wrench torque-down on the J-bolts in FIG. 3, the lever system which operates along substantially the entire rod is preferred for the greatest efficiency. For smaller frames, this may only be two or three spaced levers, and there could be more for larger sized frames. For example, the lever systems shown in FIGS. 2 and 9D each have a coupler which connects two cross-bars.

It will also be appreciated that the lever system can a single leveraging mechanism with spaced-apart rod holders or multiple leveraging mechanisms spaced along the frame. Various alternative leverage mechanisms are shown in FIG. 10. Generally, any leveraging mechanism could be used, including a winch, a ratchet lever, a fence stretcher, a pull jack, a ratchet strap or ratchet buckle. The various leveraging mechanism options can be used in conjunction with optional fasteners. For example, one pair of orthogonal rods could be fixed to their secured position by J-bolts or C-hooks while the other pair of orthogonal rods are loosely held by ratchet straps or ratchet buckles along the frame. The ratchet straps could be operated in unison with a cross-bar connected to the levers on the ratchet straps.

Figure 5A:
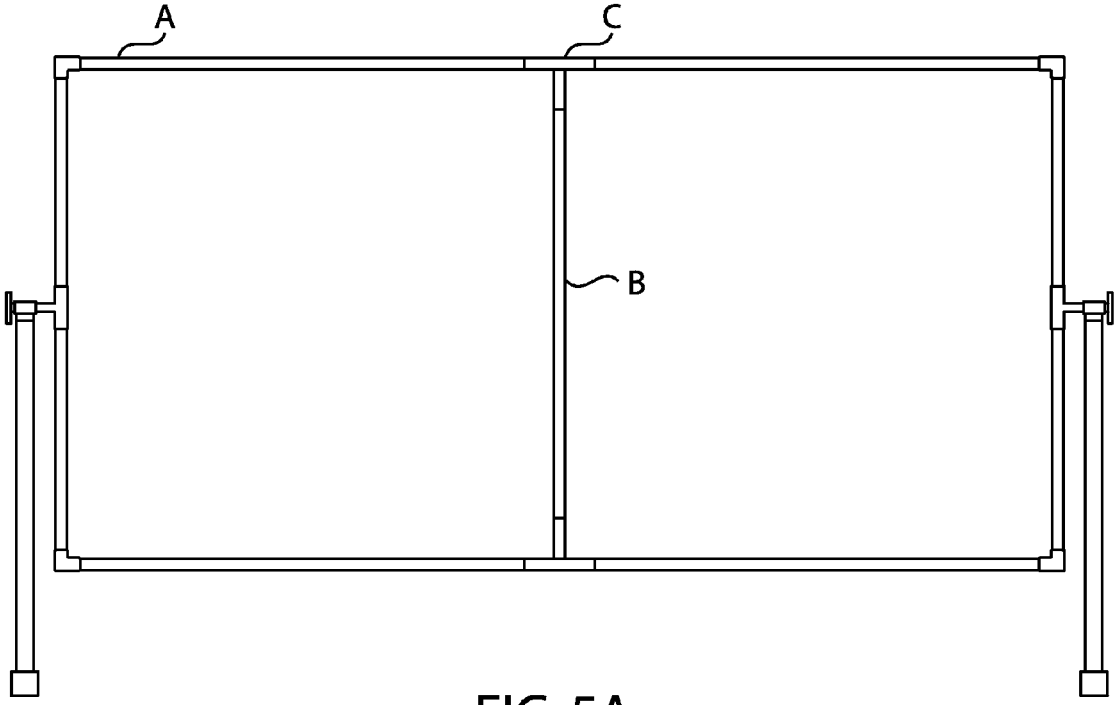
FIGS. 5A & 5C are front views of rebounder frames with alternative bracing.
Figure 5B:
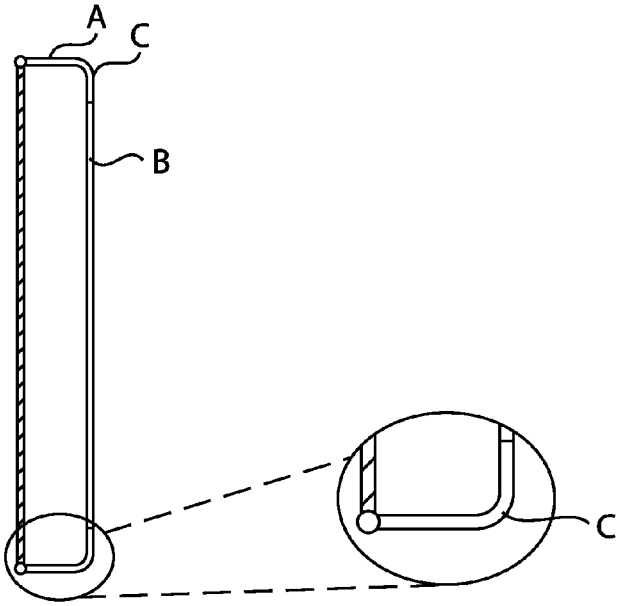
FIG. 5B is a side view of the rebounder frame shown in FIG. 5A.
Figure 5C:
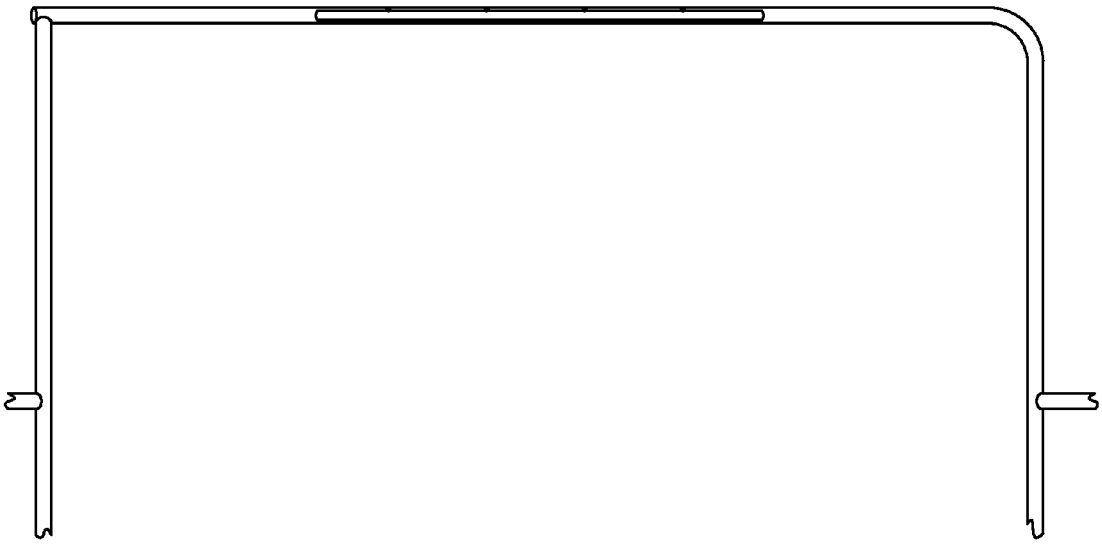
Figure 5D:
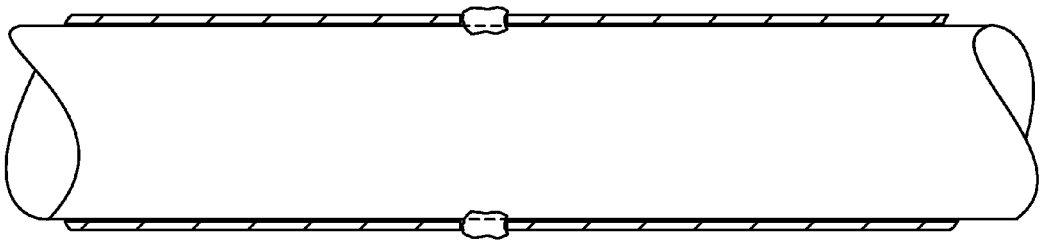
FIG. 5D is a detail view of the rebounder frame shown in FIG. 5C.

Different types of braces can be used to provide additional strength to the perimeter support which can be formed from rods, bars, tubes, beams, and any combination thereof. Most of the braces span a portion of the frame's interior space, but external truss braces can also be used, such as shown in FIG. 4. External trusses can be positioned on the top and bottom as shown or on the sides to permit the net to reach the ground. It is also possible for these trusses to be positioned within the frame's interior space and may even have an arm that extends behind the back side of the net, such as shown in FIGS. 5A and 5B. Accordingly, interior braces can be a truss or arm that spans the inside perimeter support or can be a bracket that is situated in the corners of the perimeter support. Another form of an interior brace is an inner sleeve that is situated within the tubular frame as shown in FIG. 5C. The inner sleeve provides localized rigidity to the frame. In one embodiment, the inner sleeve is positioned toward the center of the tubular frame and is spot welded in place.

Figure 6A:
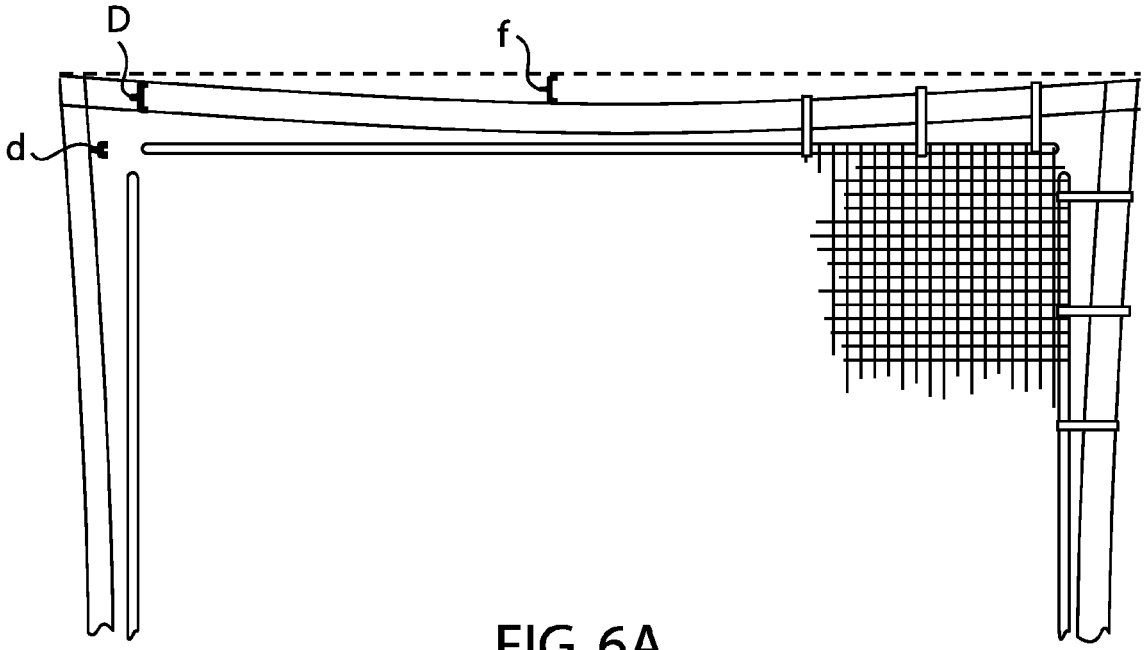
FIGS. 6A & 6B are front and side views of a rebounder with a flexible frame.
Figure 6B:
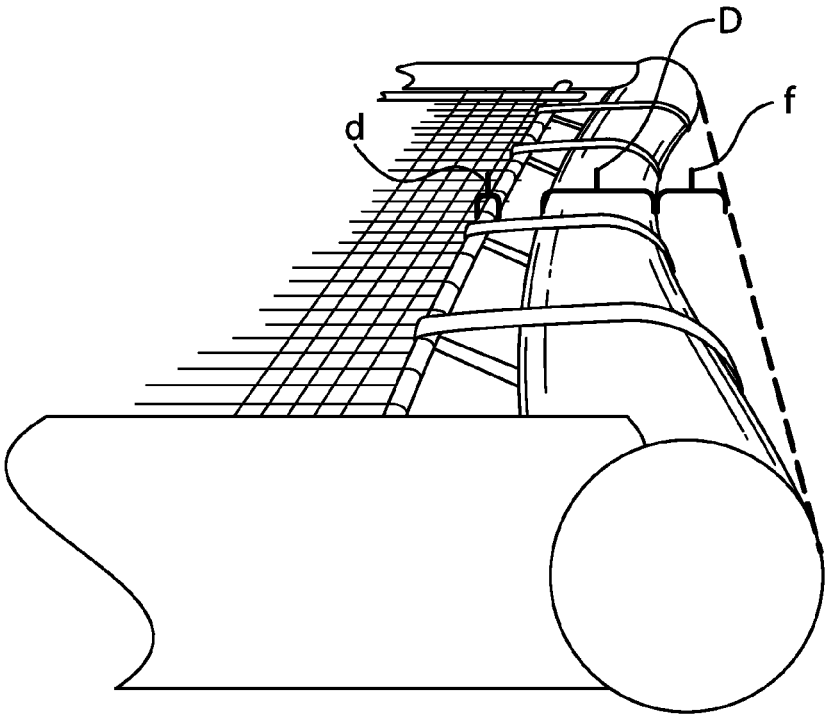

As shown in FIGS. 6A and 6B, the frame can deflect with a spring action in response to the tension that is pulled on the net. It is known from existing rebounding devices that most nets and their spring elements to the frames wear far more than the frames themselves and would produce slack in the netting, further reducing the rebounding effect. Variations in ambient conditions and the aging process of materials may cause the netting material to stretch over time and may produce fatigue in the springs, such as in the form of cyclic creep or plastic deformation. This slack and fatigue can occur very quickly in known systems, many times just from the initial use of the rebounding device if the net has not been pre-tensioned and significantly before the net and springs are near any failure, but they result in much worse rebounding performance and many times lead to replacement of the net and springs that may have otherwise been in good condition. In prior rebounding devices, the frames do not provide any mechanisms to reduce this slack as the nets and springs begin to wear down. In comparison, the spring action in the frame of the present invention also serves to take out any initial loosening of the netting material. To provide the spring action when the tension is pulled on the net, the tubular sections of the frame can deflect, bow or otherwise flex some distance (f) from the straight axis between the corners of the frame. The bowed tubular sections can have a deflection (f) greater than approximately two diameters (2*d) of the tension rod. Another measure of the maximum deflection (f) is that it can be approximately equal to the diameter (D) of the frame's tubular sections.

The posts that are secured by the ground foundation do not require any base cross-beams, and the frame of the net can be lowered all the way to the ground. For the nets that are held between posts that are installed on a stationary mount or positioned on a mobile platform, the posts are preferably connected to base rails that extend substantially perpendicular to the vertical plane of the net and which are connected by cross-beams. Both of the cross-beams can be positioned toward the back side of the vertical net so that the net can be lowered all the way to the ground, thereby permitting rebounding of ground balls for soccer and many baseball grounders. Even when the base rail and cross-beams are elevated on casters or other wheels, the fasteners holding the frame's side perimeter supports in the tilting hub's T-joints can be loosened and the frame can slide within the joints to reach the ground. Additionally, the ability to hold the rods within the frame with fasteners that can be positioned at various locations along frame allows the frame to be lowered to the ground even when the frame is inclined. Examples of alternative designs that can be used for a similar base are shown in FIG. 7C, with one design having a straight connection and between the base and the side posts and the other design having a gooseneck in which the base extends around the front and upwardly to the side post.

Figure 7J:
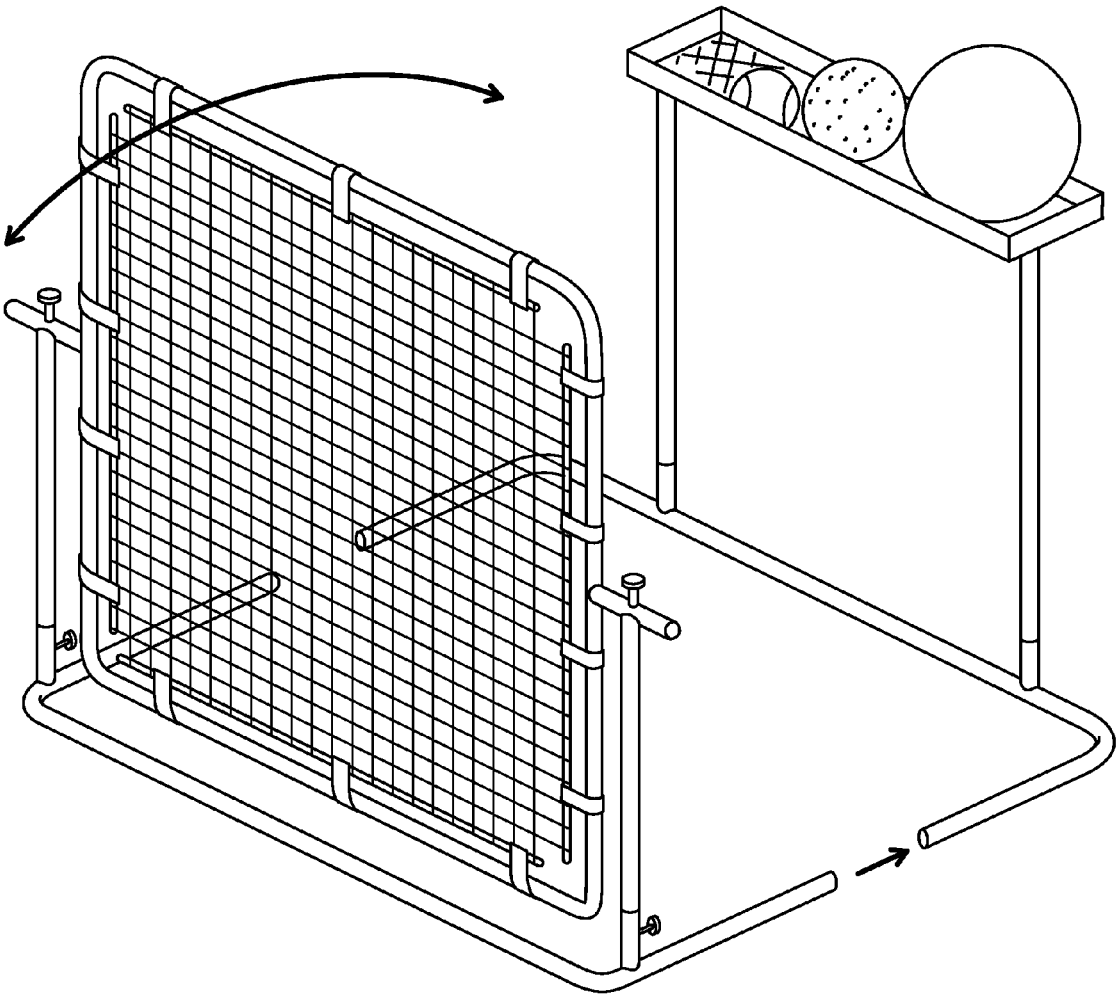
Figure 8A:
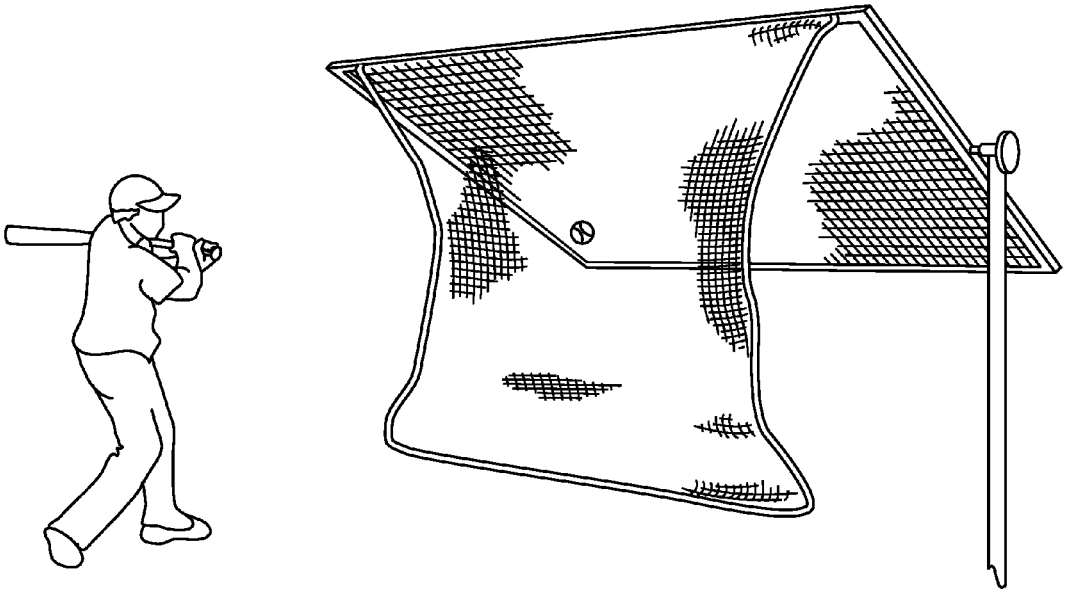
FIGS. 8A & 8B are views of rebounders with a dead blow sheet.
Figure 8B:
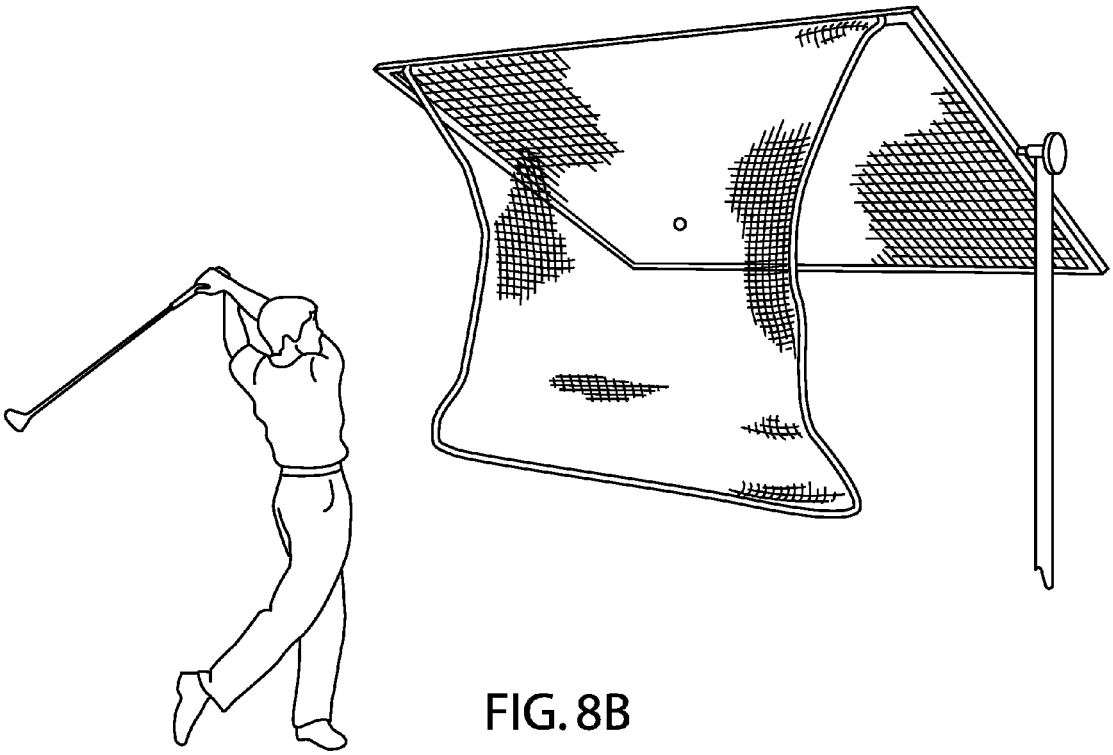

While many of the embodiments are shown as they may be used for various sports, such as soccer, lacrosse, football, baseball, softball, cricket, tennis, volleyball, golf, hockey and basketball, as particularly shown in FIG. 7J, the present invention may also be used as a physical therapy device, as its own fitness trainer or even as part of other exercise equipment. Conventional therapy devices and trainers are not well suited for lighter weight balls, and the present invention will permit light balls and heavier medicine balls to all be used depending on the ability of the users. The trainer device will improve the user's physical abilities, including hand and eye coordination, reflex speed, agility, balance and coordination, and cardio fitness. The therapy version is beneficial for users who cannot use the heavier weights and impacts that are typically required by traditional medicine ball trainers. In the particular embodiment, balls can be stored on a shelf with the trainer or any other holding device. As with the sports versions of the invention, the frame for the therapy version can be rotatably held by a pair of tilting hubs or other rotation brackets so that the user can adjust the tilt angle.

According to the ball rebounding system of the present invention, the combination of the orthogonal tension rods and the lever system nearly triple and at least double the tension in nets as compared with ball rebounding devices that use springs. Additionally, the present invention allows the same tension rods and lever system to be used for nets that have different sized cells as well as screens or other fabrics. The lever system of the present invention provides for faster and more efficient assembly of the net within the frame because the entire length of the rod can be pulled simultaneously. The ball rebounding system of the present invention can also be used to replace the nets and springs or fasteners in existing ball rebounding frames to provide a better rebound effect, and the retrofitting of the nets with the laced rods and fasteners can be provided in a kit with the lever system, optionally with pre-laced rods, so that the present invention is less time consuming than the process necessary to install the original nets.

An example of a retrofitted frame is shown in FIG. 12. The original frame with bungee cords or other spring elements holding the net in place is shown in FIG. 12A. One retrofitted rebounding device, shown in FIG. 12B, has its own frame, tension rods and net strapped onto the existing frame. However, while this retrofit is extremely easy to install, it is aesthetically unappealing and does not take advantage of the strength of the existing frame. Another retrofitted rebounding device, shown in FIG. 12C, uses the existing frame to pull the tension rods and thereby tighten the net. As indicated above, the double-frame inventions are not suitable for retrofitting existing rebounding devices because they would require drilling through metal frames to secure the inner frames at particular fixation locations that are required to hold the inner frames in place. In comparison, as described above with reference to FIG. 9 and shown in FIG. 12E, the tension rods can be pulled within the outer frame using any one of the lever mechanisms described above and shown in FIG. 11, and they can be secured with cam straps or cord straps as shown in FIGS. 12G and 12H or any other type of strap, tie or other fastener as described above. As shown in FIG. 12I, a retrofit unit could also be installed to an existing frame through rotation brackets which permits the inner unit to tilt or otherwise rotate relative to the existing frame to various angles that may be desired by the user. As shown by the detail view of the mounting bracket in FIG. 12J, the bracket could mount on the frame of an existing rebounder, and the retrofit frame could have an extension that slides into a sleeve in the bracket. The bracket could have a threaded hole with a knob-head bolt or other type of bolt that secures the tilt angle of the retrofit frame within the existing frame.

Figure 10A:
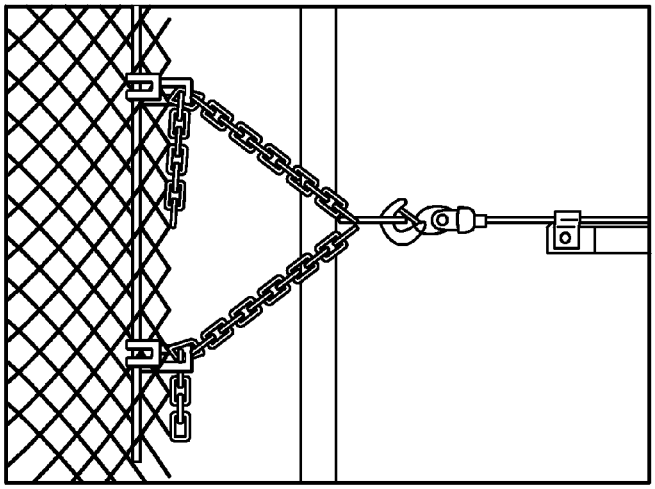
FIGS. 10A-10E are views of alternative leverage mechanisms.
Figure 10B:
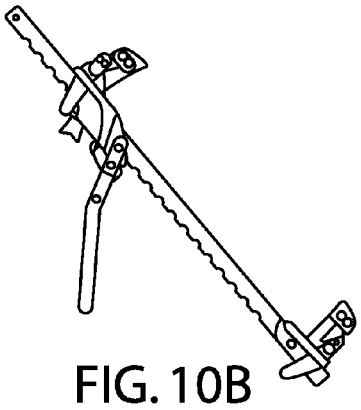
Figure 10C:
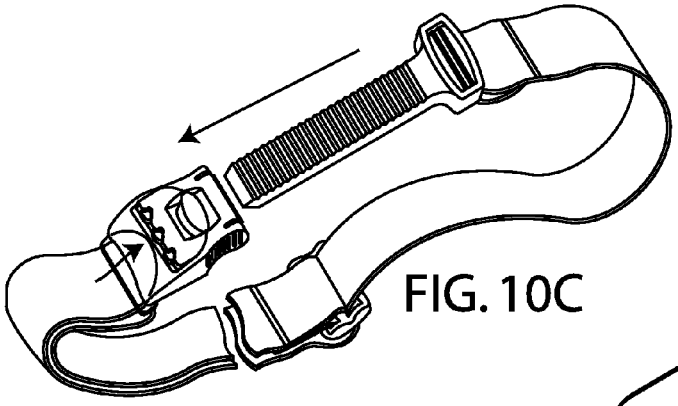
Figure 10D:
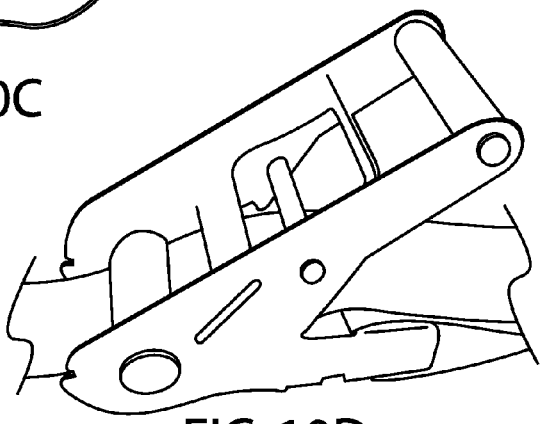
Figure 10E:
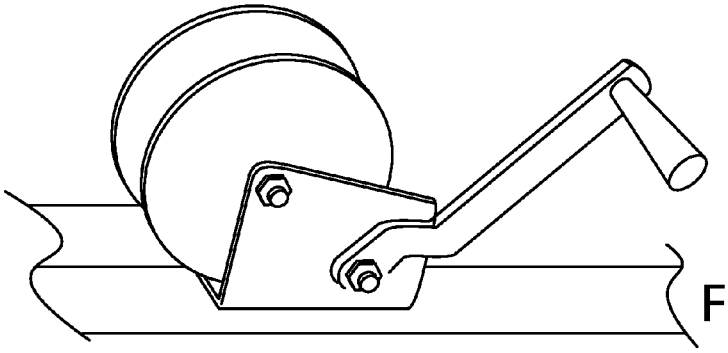
Figure 11A:
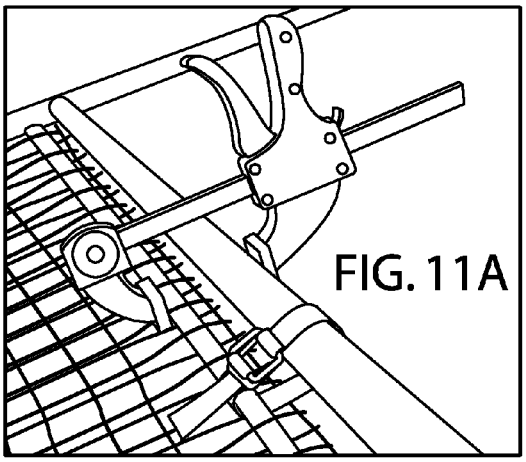
FIGS. 11A-11E are views of an alternative assembly method.
Figure 11B:
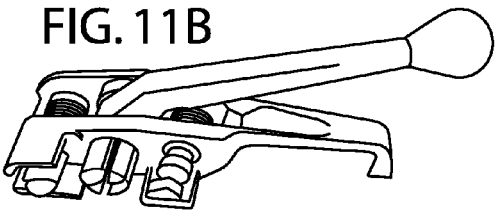
Figure 11C:
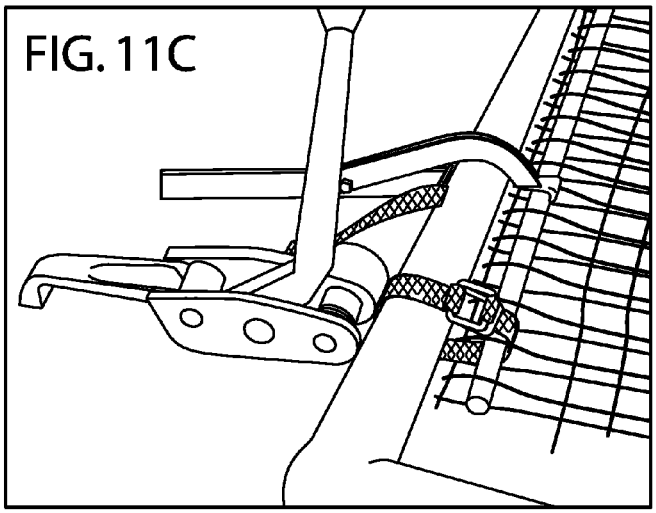
Figure 11D:
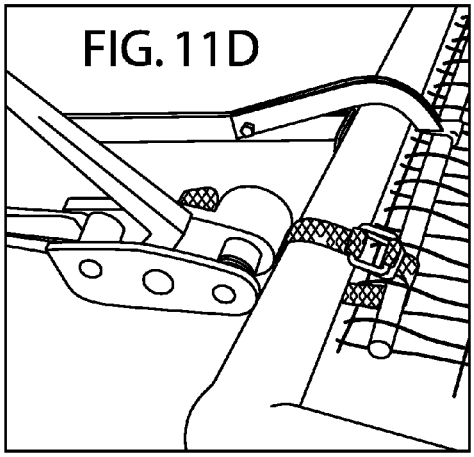
Figure 11E:
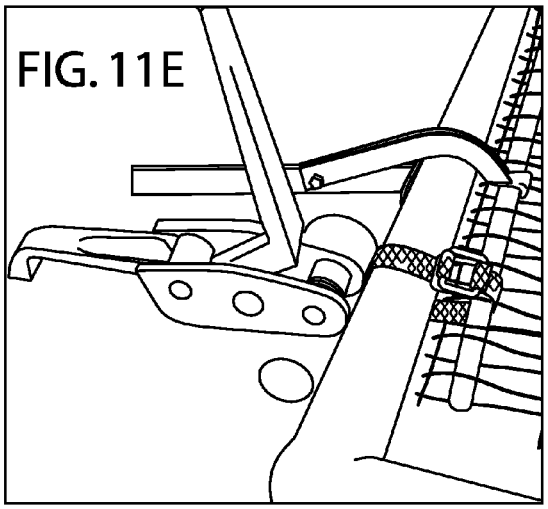
Figure 12A:
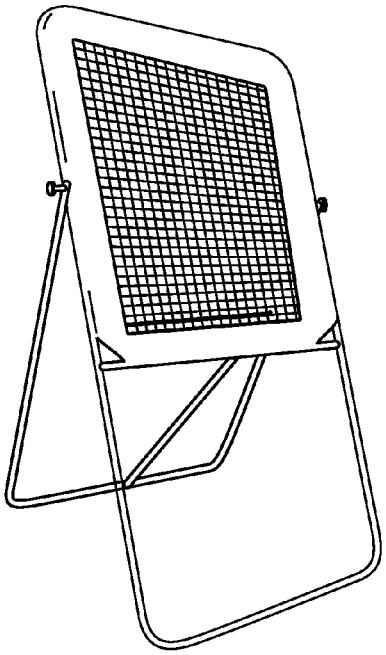
FIG. 12A (PRIOR ART)
FIGS. 12A and 12B-12J are views of an existing rebounder and retrofit options of the existing rebounder, respectively.
Figure 12B:
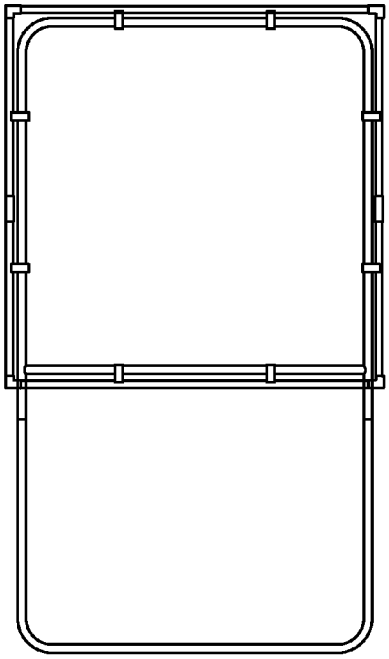
Figure 12C:
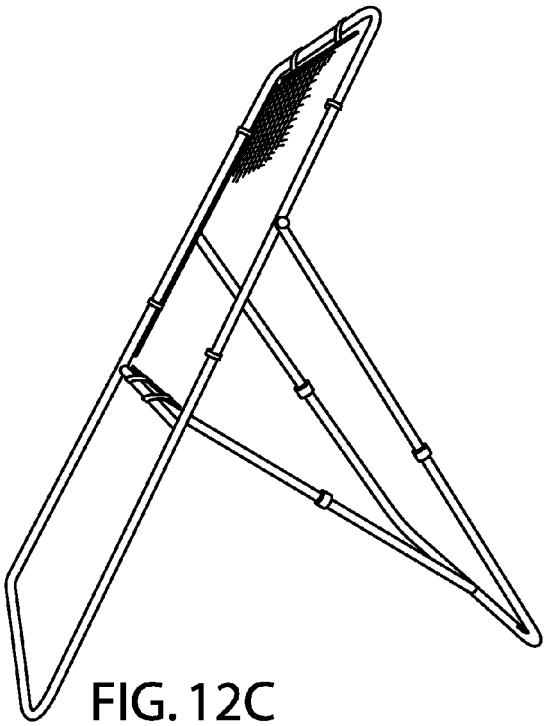
Figure 12D:
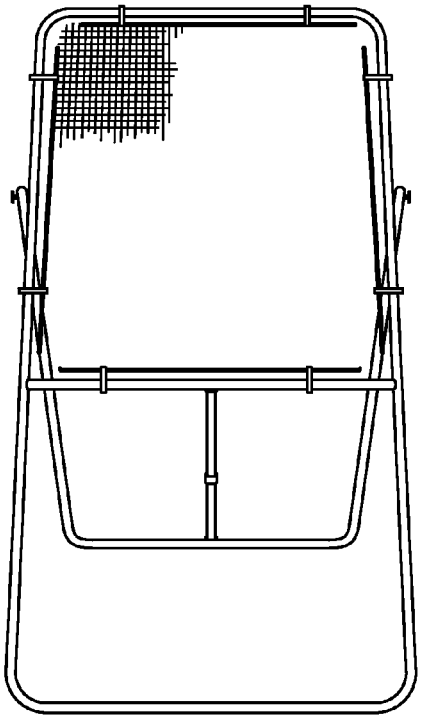
Figure 12E:
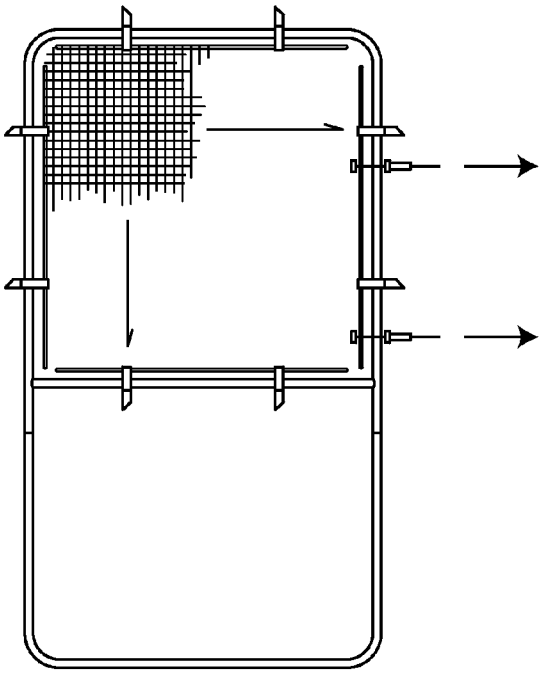
Figure 12F:
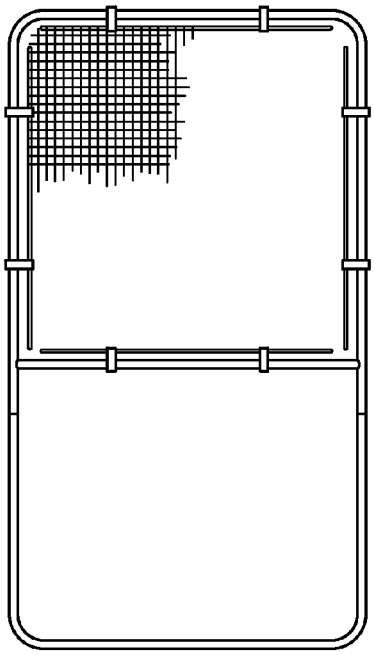
Figure 12G:
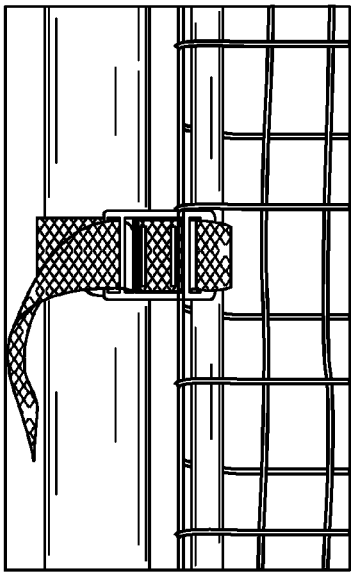
Figure 12H:
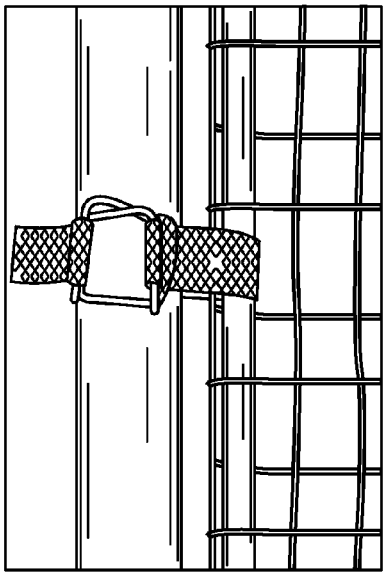
Figure 12I:
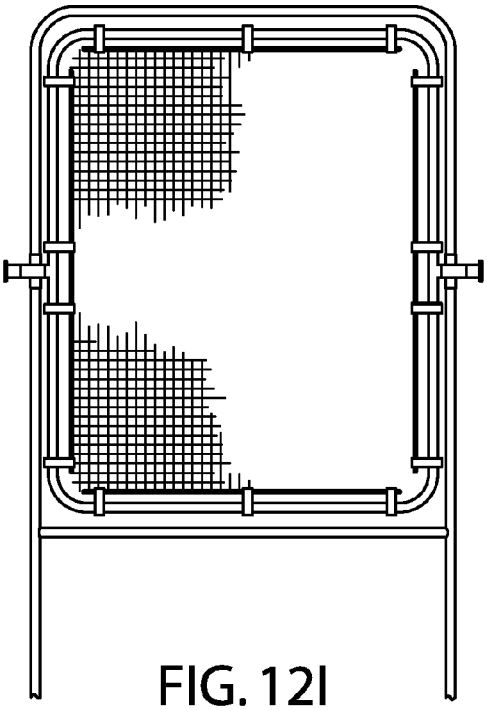
Figure 12J:
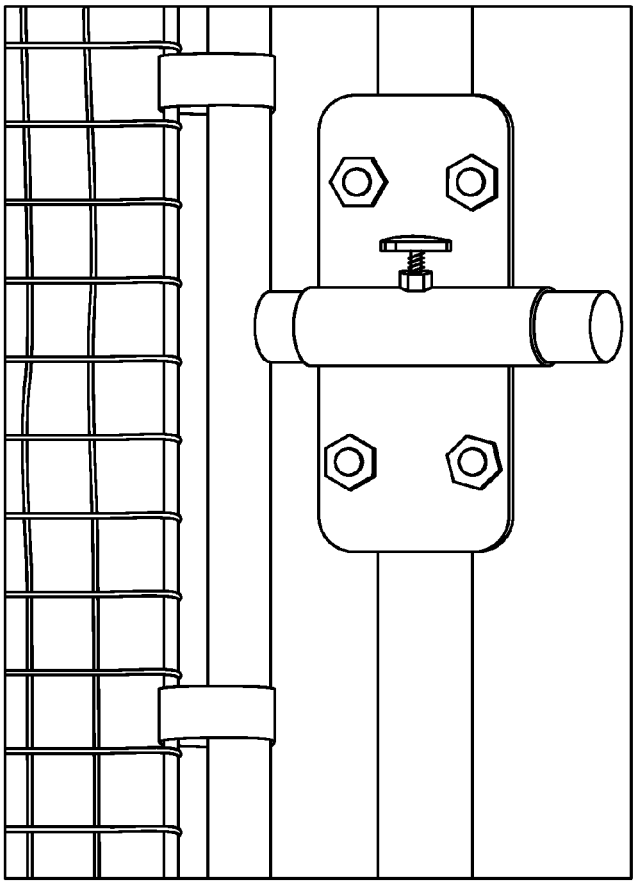

As particularly shown in FIGS. 11A-11E, one lever may be used to pull the rod close to the frame and a ratcheting strap tensioner can be used to pull the rod even closer to the frame with a strap that is used to secure the tension rod. When straps are used to secure the tension rods in position proximate to the frame, they are preferably coated with an epoxy that secures the loose ends of the straps to the portion of the strap that is wrapped around the frame and the tension rod. The addition of the epoxy prevents the straps from slipping during repeated rebounding cycles that vary the tension on the straps. Other ways to secure the loose ends of the straps could also be used. For example, hook and loop fastener elements can be provided on the strap ends and wrapped section, respectively. Of course, it will also be appreciated that the ends can simply be tied together. It will also be appreciated that one or more ratcheting strap tensioners may be used by itself without any other leveraging devices, and inexpensive versions of a ratcheting strap tensioner, such as shown in FIG. 10C, may be permanently fixed to the frame to allow the user to adjust the net tension over time and for various uses.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiments use tension rods, it will be appreciated that bars, tubes, beams could alternatively be used within the frame in place of the rods. Thus, the breadth and scope of the present invention should not be limited by any of the above-described exemplary embodiments, but should be defined only in accordance with the following claims appended hereto and their equivalents.

What is claimed is:

1. A ball rebounding system, comprising:

a frame comprising a perimeter support and an interior space within said perimeter support;

a tension rod having a first position spaced apart from said perimeter support and located in said interior space and a second position proximate to said perimeter support;

a net comprising a plurality of cells, wherein said net extends between said perimeter support within said interior space of said frame, and wherein a row of said cells are directly laced onto said tension rod without any intermediate spring elements and without any cell-position limitations or cell-size limitations according to any position or size requirements of connection points on said frame;

a lever system operatively connected to said tension rod and to said frame, wherein said lever pulls said tension rod from said first position to said second position, wherein said net is in a substantially slackened state when said tension rod is in said first position and wherein said net is in a taut state when said tension rod is in said second position; and a plurality of fasteners connecting said tension rod to said frame when said tension rod is in said second position.

2. The system of claim 1, wherein said frame further comprises a brace extending between said perimeter support, wherein said brace is selected from the group of supports consisting of a truss, a bracket, an arm, and any combination thereof, and wherein said perimeter support and said tension rod are each selected from the group of supports consisting of rods, bars, tubes, beams, and any combination thereof.

3. The system of claim 1 wherein said frame further comprises a first side and a second side opposite from said first side, wherein said tension rod has a length extending from a first end proximate to said first side of said frame and a second end proximate to said second end of said frame, wherein said lever system simultaneously pulls said tension rod at a plurality of spaced-apart locations between said first end and said second end, and wherein a furthest distance between said spaced-apart locations is at least one half of said length between said first end and said second end, and wherein said frame is straight when said tension rod is in said first position and is bowed when said tension rod is in said second position.

4. The system of claim 1, wherein said lever system is selected from the group of lever mechanisms consisting of a removably attached lever mechanism and a permanently fixed lever mechanism, wherein said removably attached lever mechanism has a first end removably connected to said frame and a second end removably connected to said tension rod, and wherein said permanently fixed lever mechanism is fixedly connected to said frame and pulls said tension rod from said first position to said second position through said plurality of fasteners.

5. The system of claim 4, wherein said lever system is comprised of a plurality of lever bars, wherein said lever bars have a spaced apart arrangement on said frame, said spaced apart arrangement having positions between ends of said rod and a center of said rod.

6. The system of claim 5, wherein said lever system is further comprised of a plurality of lever bars between said center of said rod and each of said ends of said rod and a cross-bar connected between said lever bars, wherein each of said lever bars has an elongated lever arm with a frame-grip at one end, a hand-grip at an opposite end and a rod-grip extension rotatably connected to said lever arm between a middle point and said frame-grip.

7. The system of claim 1, wherein said lever system is comprised of a leveraging mechanism and a plurality of spaced-apart rod holders, wherein said leveraging mechanism is selected from the group consisting of a winch, a ratchet lever, a fence stretcher, a pull jack, a ratchet strap and a ratchet buckle.

8. The system of claim 1, wherein said net is comprised of a fabric, wherein said row of cells are comprised of a plurality of reinforced holes along a margin of said fabric, and wherein said reinforced holes are sized to be larger in diameter than said tension rod.

9. The system of claim 1, further comprising a plurality of tension rods and a pair of legs, wherein a first pair of orthogonally situated tension rods are arranged in said first position spaced apart from said perimeter support and located in said interior space and are pulled by said lever system to said second position proximate to said perimeter support, wherein said pair of legs are connected to opposite sides of said perimeter support, wherein said pair of legs extend in the same direction relative to the opposite sides of said perimeter support, and wherein said legs are selected from the group of legs consisting of permanent fixed posts, replaceable legs, leg extensions, and an outer existing frame with legs.

10. The system of claim 9, wherein a second pair of orthogonally situated tension rods are arranged in said second position proximate to said perimeter support and are held in place by said plurality of fasteners while said lever system pulls said first pair of tension rods from said first position to said second position.

11. A ball rebounding system, comprising:

a frame comprising a perimeter support and an interior space within said perimeter support;

a plurality of tension rods having a first position spaced apart from said perimeter support and located in said interior space and a second position proximate to said perimeter support;

a net comprising a plurality of cells, wherein said net extends between said perimeter support within said interior space of said frame, and wherein rows of said cells proximate to a boundary of said net are directly laced onto said tension rods without any intermediate spring elements and are freely aligned along said tension rods relative to said perimeter support without any cell-position limitations or cell-size limitations according to any position or size requirements of connection points on said frame;

a lever system operatively connected to at least two of said tension rods and to said frame, wherein said lever pulls said tension rods from said first position to said second position, wherein said net is in a substantially slackened state when said tension rods are in said first position, and wherein said net is in a taut state when said tension rods are in said second position; and a plurality of fasteners connecting said tension rods to said frame when said tension rods are in said second position.

12. A method for creating tension in a ball rebounding system, comprising the steps of:

providing a frame comprising a perimeter support and an interior space within said perimeter support;

providing two pairs of orthogonally arranged tension rods, wherein each of said tension rods has a first end proximate to one end of said perimeter support and a second end proximate to an opposite end of said perimeter support;

lacing a net directly onto said tension rods, wherein said net comprises a plurality of cells, and wherein each of said tension rods is laced with a row of said cells;

securing one of said two pairs of orthogonally arranged tension rods to said frame proximate to said perimeter support; and pulling another of said two pairs of orthogonally arranged tension rods by a lever mechanism from a first position spaced apart from said perimeter support and located in said interior space to a second position proximate to said perimeter support, wherein a plurality of spaced-apart locations between said first end and said second end of said tension rods are simultaneously pulled by said lever mechanism from said first position to said second position when said tension rods are being pulled.

13. A ball rebounding system, comprising:

a frame, said frame forming a perimeter support and an interior space within the perimeter support;

a first pair of orthogonally arranged tension rods, wherein each of said tension rods has a first position spaced apart from said perimeter support and located in said interior space and a second position proximate to said perimeter support;

a pair of legs, wherein said pair of legs extend in the same direction relative to the opposite sides of the frame;

a pair of extensions, wherein said pair of extensions project away from said interior space on opposite sides of said frame;

a pair of rotation brackets, wherein each one of said rotation brackets is further comprised of a sleeve and a locking element and is mounted on a respective one of said pair of legs, wherein each one of said pair of extensions slides into a respective sleeve, and wherein said frame is rotatable relative to said legs through said pair of extensions in said respective pair of rotation brackets;

a net comprising a plurality of cells, wherein said net extends between said perimeter support within said interior space of said frame, and wherein a row of said cells proximate to a boundary of said net are directly laced onto said tension rods without any intermediate spring elements; and a plurality of straps connecting said tension rods to said frame when said tension rods are in said first position and in said second position, wherein said straps are inelastic and connect said tension rods to said frame without any intermediate spring element.

14. The system of claim 13, wherein said frame is straight when said tension rods are in said first position and is bowed when said tension rods are in said second position, wherein a first set of said straps connects a first one of said first pair of orthogonally arranged tension rods to said frame without any intermediate spring element and a second set of said straps connects a second one of said first pair of orthogonally arranged tension rods to said frame without any intermediate spring element, and wherein said cells are freely aligned along said tension rods relative to the perimeter support without any cell-position limitations or cell-size limitations according to any position or size requirements of connection points on said frame.

15. The system of claim 13, wherein said locking element is further comprised of a pair of knob-head bolts, wherein each one of said rotation brackets is further comprised of a threaded hole, and wherein said knob-head bolts respectively screw into said threaded hole and engage said pair of extensions within said corresponding sleeves.

16. The system of claim 13, further comprising:

a second pair of orthogonally arranged tension rods opposite from said first pair of tension rods, wherein said second pair of tension rods are secured to said frame proximate to the perimeter support as said first pair of tension rods are moved from said first position to said second position; and a lever system operatively connected to said first pair of tension rods and to said frame, wherein said lever pulls said tension rods from said first position to said second position, wherein said net is in a substantially slackened state when said tension rods are in said first position, and wherein said net is in a taut state when said tension rods are in said second position.

17. The system of claim 16, wherein said lever system is comprised of a ratcheting strap tensioner and a buckle strap wrapped around said frame and said rod.

18. The system of claim 16, wherein said lever system is comprised of a plurality of lever bars, wherein said lever bars have a spaced apart arrangement on said frame, said spaced apart arrangement having positions between ends of said rod and a center of said rod.

19. The system of claim 16, wherein said lever system is comprised of a leveraging mechanism and a plurality of spaced-apart rod holders, wherein said leveraging mechanism is selected from the group consisting of a winch, a ratchet lever, a fence stretcher, a pull jack, a ratchet strap and a ratchet buckle.

20. A ball rebounding system, comprising:

a frame comprising a perimeter support and an interior space within said perimeter support;

a pair of tension rods, wherein each of said tension rods has a first position spaced apart from said perimeter support and located in said interior space and a second position proximate to said perimeter support, wherein said frame is straight when said tension rods are in said first position and is bowed when said tension rods are in said second position;

a net comprising a plurality of cells, wherein said net extends between said perimeter support within said interior space of said frame, and wherein rows of said cells proximate to a boundary of said net are directly laced onto said tension rods without any intermediate spring elements and are freely aligned along said tension rods relative to said perimeter support without any cell-position limitations or cell-size limitations according to any position or size requirements of connection points on said frame; and a plurality of straps connecting said tension rods to said frame when said tension rods are in said first position and in said second position.

21. The system of claim 20, wherein said frame is comprised of a plurality of tubular sections forming said perimeter support, wherein said tubular sections are straight when said tension rods are in said first position and wherein said tubular sections are bowed when said tension rods are in said second position.

22. The system of claim 20, wherein said bowed frame has a deflection greater than approximately at least one diameter of said tension rod.

23. The system of claim 20, wherein said frame is comprised of a plurality of tubular sections forming said perimeter support, and wherein said bowed frame has a deflection greater than a radius of said tubular sections.

24. The system of claim 20, wherein said frame is comprised of a plurality of tubular sections forming said perimeter support, and wherein said bowed frame has a deflection approximately equal to a diameter of said tubular sections.

25. The system of claim 20, further comprising another pair of tension rods, a pair of mounting brackets and at least one of a pair of legs and an outer existing frame, wherein said outer existing frame comprises a pair of existing legs, wherein said pair of legs or said pair of existing legs is connected to opposite sides of said frame through said pair of mounting brackets and extend in the same direction relative to the opposite sides of said frame, and wherein each pair of tension rods is orthogonally arranged within said frame.

26. A ball rebounding system for use within an outer existing frame, comprising:

a pair of locking brackets attached to the outer existing frame, wherein said pair of locking brackets are a pair of rotation brackets, and wherein each of said rotation brackets is further comprised of a sleeve and a locking element;

an inner frame fitting within the outer existing frame, wherein said inner frame is comprised of a plurality of side sections, wherein opposite sides of said inner frame are connected to the outer existing frame through said pair of locking brackets, wherein said inner frame is rotatable relative to the outer existing frame through said pair of rotation brackets, wherein said inner frame forms a perimeter support and an interior space within the perimeter support, wherein a pair of opposing side sections each further comprise an extension projecting away from said interior space, and wherein said extension slides into said sleeve and said locking element holds said inner frame at an angular tilt relative to the outer existing frame;

a first pair of orthogonally arranged tension rods, wherein each of said orthogonally arranged tension rods has a first position spaced apart from said inner frame and a second position proximate to said inner frame, and wherein said inner frame is straight when said first pair of orthogonally arranged tension rods are in said first position and is bowed when said first pair of orthogonally arranged tension rods are in said second position;

a net comprising a plurality of cells, wherein said net extends between said inner frame, and wherein a row of said cells proximate to a boundary of said net are directly laced onto said orthogonally arranged tension rods without any intermediate spring elements; and a plurality of straps connecting said orthogonally arranged tension rods to said inner frame when said orthogonally arranged tension rods are in said first position and in said second position, wherein said straps are inelastic and connect said tension rods to said inner frame without any intermediate spring element.

27. The system of claim 26, further comprising a second pair of orthogonally arranged tension rods opposite from said first pair of orthogonally arranged tension rods, wherein said second pair of orthogonally arranged tension rods are secured to the inner frame proximate to the perimeter support as said first pair of orthogonally arranged tension rods are moved from said first position to said second position, wherein a first set of said straps connects a first one of said first pair of orthogonally arranged tension rods to said inner frame without any intermediate spring element and a second set of said straps connects a second one of said first pair of orthogonally arranged tension rods to said inner frame without any intermediate spring element.

28. The system of claim 26, further comprising a lever system operatively connected to said first pair of orthogonally arranged tension rods and to said inner frame but not connected to the outer existing frame, wherein said lever pulls said orthogonally arranged tension rods from said first position to said second position, wherein said net is in a substantially slackened state when said orthogonally arranged tension rods are in said first position, and wherein said net is in a taut state when said orthogonally arranged tension rods are in said second position.

29. The system of claim 26, wherein said locking element is further comprised of a pair of knob-head bolts, wherein each one of said rotation brackets is further comprised of a threaded hole, and wherein said knob-head bolts respectively screw into said threaded hole and engage said pair of extensions within said corresponding sleeves.

* * * * *